United States Patent [19]

Jones

[11] 4,091,596

[45] May 30, 1978

[54] METHOD OF AND APPARATUS FOR MANUFACTURING ENVELOPES

[75] Inventor: Charles L. Jones, Ledyard, Conn.

[73] Assignee: EnMail Machine Corporation, New York, N.Y.

[21] Appl. No.: 699,301

[22] Filed: Jun. 24, 1976

Related U.S. Application Data

[63] Continuation-in-part of Ser. No. 689,936, May 25, 1976, abandoned, which is a continuation of Ser. No. 551,723, Feb. 21, 1975, abandoned.

[51] Int. Cl.[2] ..... B65B 11/48

[52] U.S. Cl. ..... 53/31; 53/32; 53/207; 53/208; 53/209; 93/63 R

[58] Field of Search ..... 53/31, 32, 206, 207, 53/208, 209, 218, 266 A; 93/61 R, 63 M, 63 R; 271/246, 273

[56] References Cited

U.S. PATENT DOCUMENTS

| | | | |
|---|---|---|---|
| 1,172,824 | 2/1916 | Newman | 53/266 A |
| 1,889,958 | 12/1932 | Frech | 53/206 |
| 2,102,001 | 12/1937 | Heywood | 93/63 M |
| 2,974,461 | 3/1961 | Demier | 53/209 X |
| 3,015,485 | 1/1962 | Smith | 271/246 |
| 3,218,064 | 11/1965 | Davidson, Jr. et al. | 271/273 |
| 3,242,637 | 3/1966 | Wills | 53/266 A |
| 3,263,992 | 8/1966 | Schrempp | 271/273 X |
| 3,288,037 | 11/1966 | Burnett | 93/61 R |
| 3,298,682 | 1/1967 | Gatti | 271/273 X |
| 3,685,253 | 8/1972 | Herrell et al. | 53/218 X |

*Primary Examiner*—Othell M. Simpson
*Assistant Examiner*—John Sipos
*Attorney, Agent, or Firm*—Wilfred F. DesRosiers

[57] ABSTRACT

A method of and a machine for the simultaneous forming of and stuffing of an insert into an envelope blanked from a paper web wherein the web is intermittently advanced along a first path, scored along preselected fold lines and notched at preselected spaced intervals for defining unsevered envelope blanks having a bottom flap, a closure flap and end flaps. The bottom flap of each envelope blank is folded as the web advances along the first path to form a pocket, the leading envelope blank is stopped and registered at a preselected position, severed and charged with an insert into the pocket defined by the bottom flap. The charged envelope blank is advanced along a second path perpendicular to the first path, where adhesive is applied to the end flaps, the end flaps folded into sealing relationship with the bottom flap. The charged envelope blank is then advanced along a third path perpendicular to the second path where adhesive is applied to the closure flap and the closure flap folded into sealed relationship with the bottom and end flaps.

20 Claims, 32 Drawing Figures

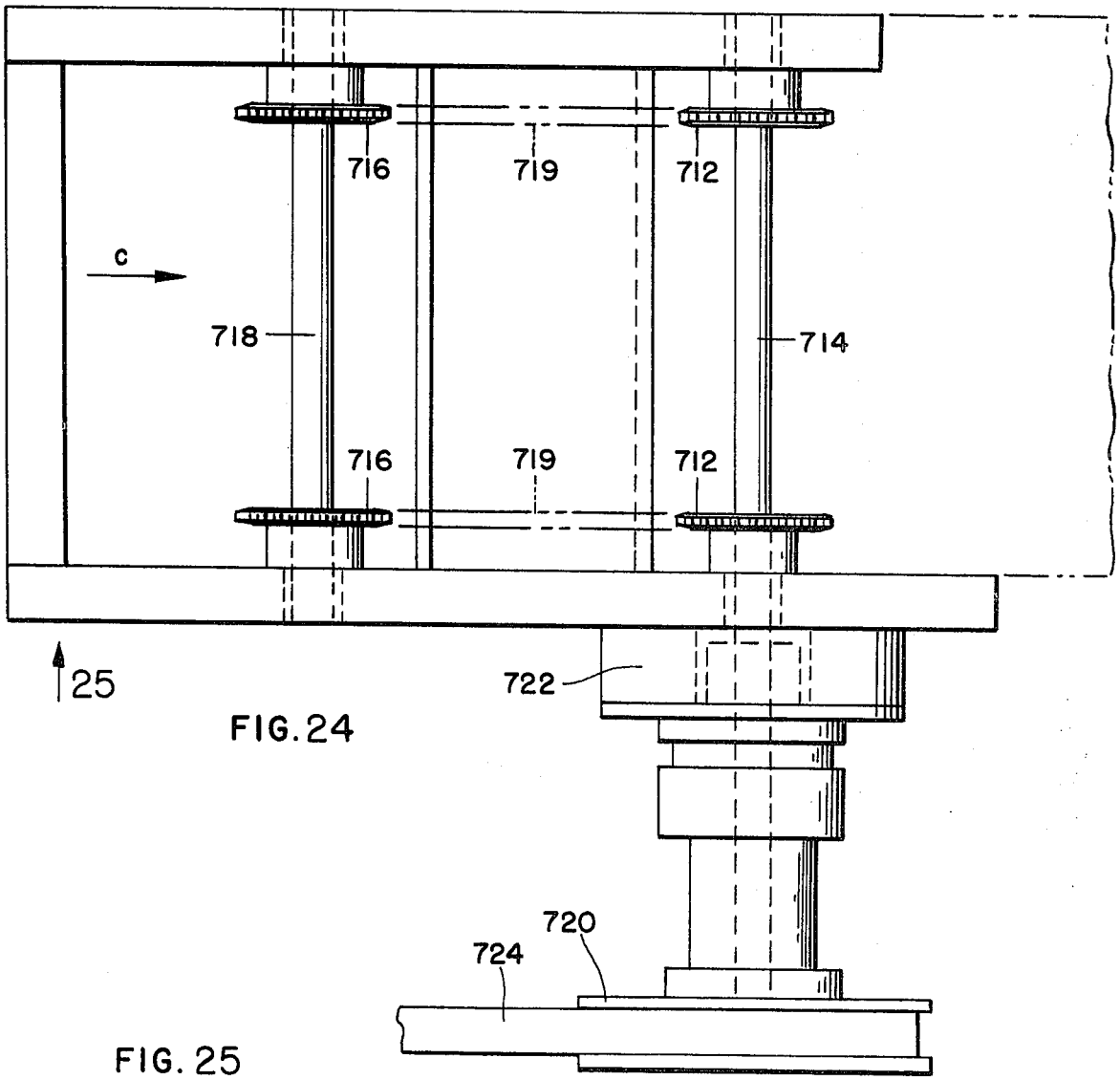
FIG. 24
FIG. 25
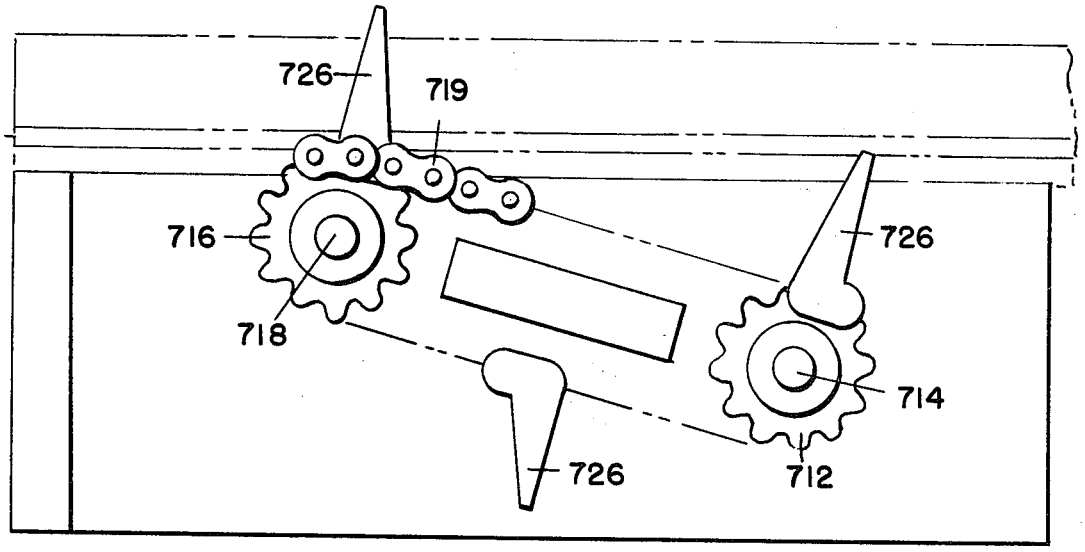

METHOD OF AND APPARATUS FOR MANUFACTURING ENVELOPES

This application is a continuation-in-part of my copending application Ser. No. 689,936 filed May 25, 1976 for ENVELOPE MANUFACTURE now abandoned which in turn is a continuation of my application Ser. No. 551,723 filed Feb. 21, 1975 for ENVELOPE MANUFACTURE, now abandoned.

BACKGROUND OF THE INVENTION

1. Field of the Invention

The invention is directed to a means of and a machine for inserting inserts into successive leading ends of a paper web while the web is formed into successive envelope blanks.

2. Description of the Prior Art

It has long been practice to form inserts and envelopes at separate locations and to assemble the completed packages (envelopes and inserts) at a situs remote from the apparatus for the preparation of either component as shown, for example, in U.S. Pat. No. 1,889,958 of Dec. 6, 1932.

Likewise, it has been practice to preliminarily perform upon a paper web appropriate blanking and scoring operations to enable the operator to bring to the envelope-making machine a prepared web, usually in roll form, to serve the envelope-making function of that machine.

Too, it has also been known to stack an insert and to fold a blank relative thereto during passage along a continuous single line by laying the insert upon a preformed and precut envelope blank, folding the blank along predetermined lines and glued in certain areas, so that there is formed a mailing piece inclusive of envelope and insert. An example of such a system is shown in U.S. Pat. No. 3,457,696 of July 29, 1969.

Such a system has dictated the use of precut envelope blanks, itself representing unnecessary expense, as well as the feature of the partial gumming and drying of the adhesive in advance of the insertion operation. In addition, the blanks need to be carefully stacked to the end that they may be appropriately delivered for the inserting and folding stages, suggesting the need of an attendant or auxiliary equipment, not to mention constant attendance on the part of maintenance personnel.

There are other known envelope manufacturing systems in which a continuous paper web is advanced from a supply roll. The moving web is scored and notched at spaced intervals to define envelope blanks having side flaps and unsevered end flaps. As the still unsevered envelope blanks are advanced, insert material is deposited on the blanks and the side flaps are folded over the insert material. Adhesive is applied to the upwardly exposed portions of the folded side flaps. The blanks are then severed from the moving web to define free end flaps, which are then folded over the side flaps to form completed envelopes having inserts sealed therein. An example of such a system is disclosed in U.S. Pat. No. 3,628,304 issued Dec. 21, 1971.

SUMMARY OF THE INVENTION

The present invention is primarily directed to the last described system of envelop formation with simultaneous insertion of insert material wherein the envelopes are blanked from a continuous paper web.

It is a principal object of the present invention to provide a method of and apparatus for forming envelope blanks from a continuous web and folding the flaps and including the insert material in a more efficient and positive manner than prior art systems.

The primary object of the invention is accomplished by folding one of the side flaps, commonly referred to as the bottom flap, after each envelope has been blanked to form a pocket while the unsevered envelope blank is advanced along a first direction. The envelope blank is stopped and severed at a predetermined location while insert material is charged into the pocket formed by the bottom flap. The bottom flap is pressed down onto the insert material and the charged and severed envelope blank is advanced along a second path which is perpendicular to the first path where the end flaps are glued and folded down into sealing relationship against the bottom flap. The charged envelope blank is then advanced along a third path which is perpendicular to the second path where the remaining side flap, commonly referred to as the closure flap, is glued and folded into sealing relationship with the end and bottom flaps.

The pocket formed by the folded bottom flap aids in receiving and positioning the inserted material. Also, it is easier to fold the bottom flap while the blank moves in this first direction. The movement of the charged envelope blank in the second direction insures that the insert material stabilized within the bottom flap pocket and also makes it easier to gum and seal the end flaps the score lines of which extend along an axis which is perpendicular to the axis of the first direction of movement. The second change in direction of the charged envelope blank also insures that the second side flap or closure flap is more easily gummed and sealed since the score line this flap extends along an axis which is perpendicular to the second direction of movement.

The present invention avoids the cumbersome systems of effecting gumming, folding and sealing of different sides of a blank while it is being advanced along a single path of movement. The design of the machine for carrying out the invention is greatly simplified and results in a compact, easily serviced and reliable machine.

The machine for carrying out the present invention also includes novel machine components for transporting the envelope blank in the three different directions. These components maintain a positive control of the blank throughout the entire envelope manufacturing and insert charging procedure.

Other advantages of the present invention will become apparent from a reading of the detailed description when taken together with the drawings in which:

BRIEF DESCRIPTION OF THE DRAWINGS

FIG. 24 is a fragmentary plan view of the means for transferring a charged envelope blank from the second transfer station;

FIG. 25 is an elevation looking in the direction of arrow 25 of FIG. 24;

DESCRIPTION OF THE PREFERRED EMBODIMENT

Figure 3:
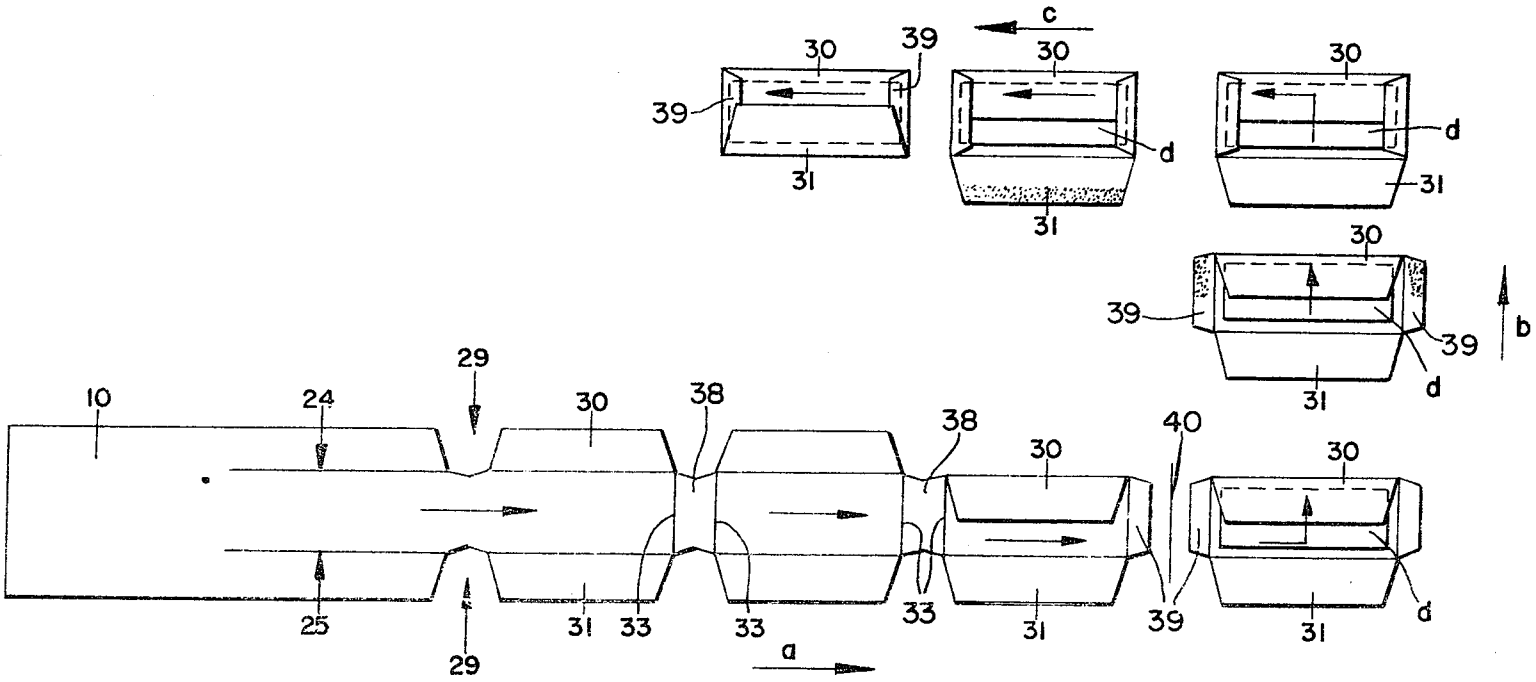
FIG. 3 is a schematic view of the steps of forming an envelope from a continuous paper web and simultaneous incorporation of insert material therein in accordance with the present invention.
Figure 14:
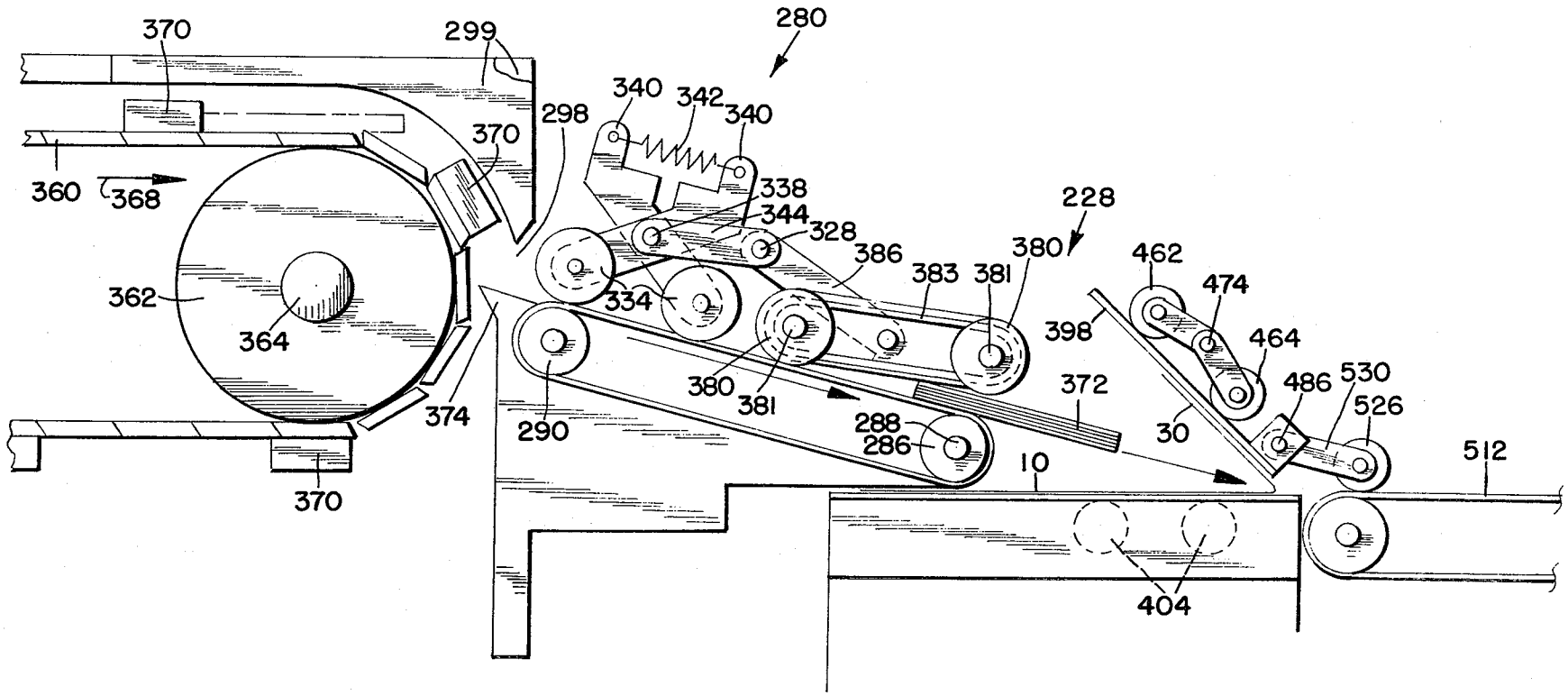
FIG. 14 is a view similar to FIG. 12, showing the charge of insert material being inserted into the pocket of an envelope blank.

Referring first to FIG. 3, the method of the present invention is illustrated schematically and very generally so that the reader will be properly oriented in following the detailed descriptions of the various components. As shown in FIG. 3, a continuous paper web 10 is advanced along a first path indicated by arrow *a*. As the web 10 is advanced in this direction long score lines 24 and 25 are formed into the web and the web is notched as at 29. Short, or cross, score lines 33 are then formed into the web to complete an envelope blank which comprises a first long flap, or bottom flap 30, a second long flap, or closure flap 31. The blanks are interconnected by central portions 38 which are later severed at the center thereof to form end flaps 39, as shown at the extreme right of FIG. 3. Before the section 38 is severed the first long flap or closure flap 30, is folded toward the center of the blank at an acute angle with respect to the blank. This angle is not shown in the Figure, but is illustrated in FIG. 14 to form a pocket. As the web is severed along line 40, insert material indicated at *d* is inserted into the pocket formed by the bottom flap 30. The severed and charged blank is shown at the lower right hand corner in FIG. 3. This charged blank is then moved along a second path indicated at *b* which is perpendicular to path *a*. As the charged blank advances along path *b*, adhesive is applied to the leading portions of end flaps 39. These end flaps are then folded into sealing relationship with the bottom flap 30 as shown in the upper right hand corner in FIG. 3. The charged envelope blank is then advanced along a third path indicated by arrow *c*. As the charged envelope is advanced along path *c*, glue is applied to the closure flap 31 and this flap is folded into sealing relationship with the end flaps 39 and bottom flap 30 as shown in the upper left hand corner of FIG. 3 to form the completed envelope.

FEED OF WEB ALONG FIRST PATH

Figure 30:
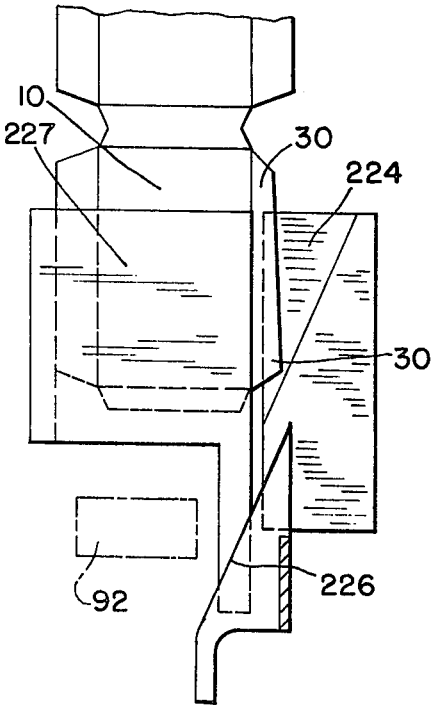
FIG. 30 is a detailed plan view of the first plow station.
Figure 1A:
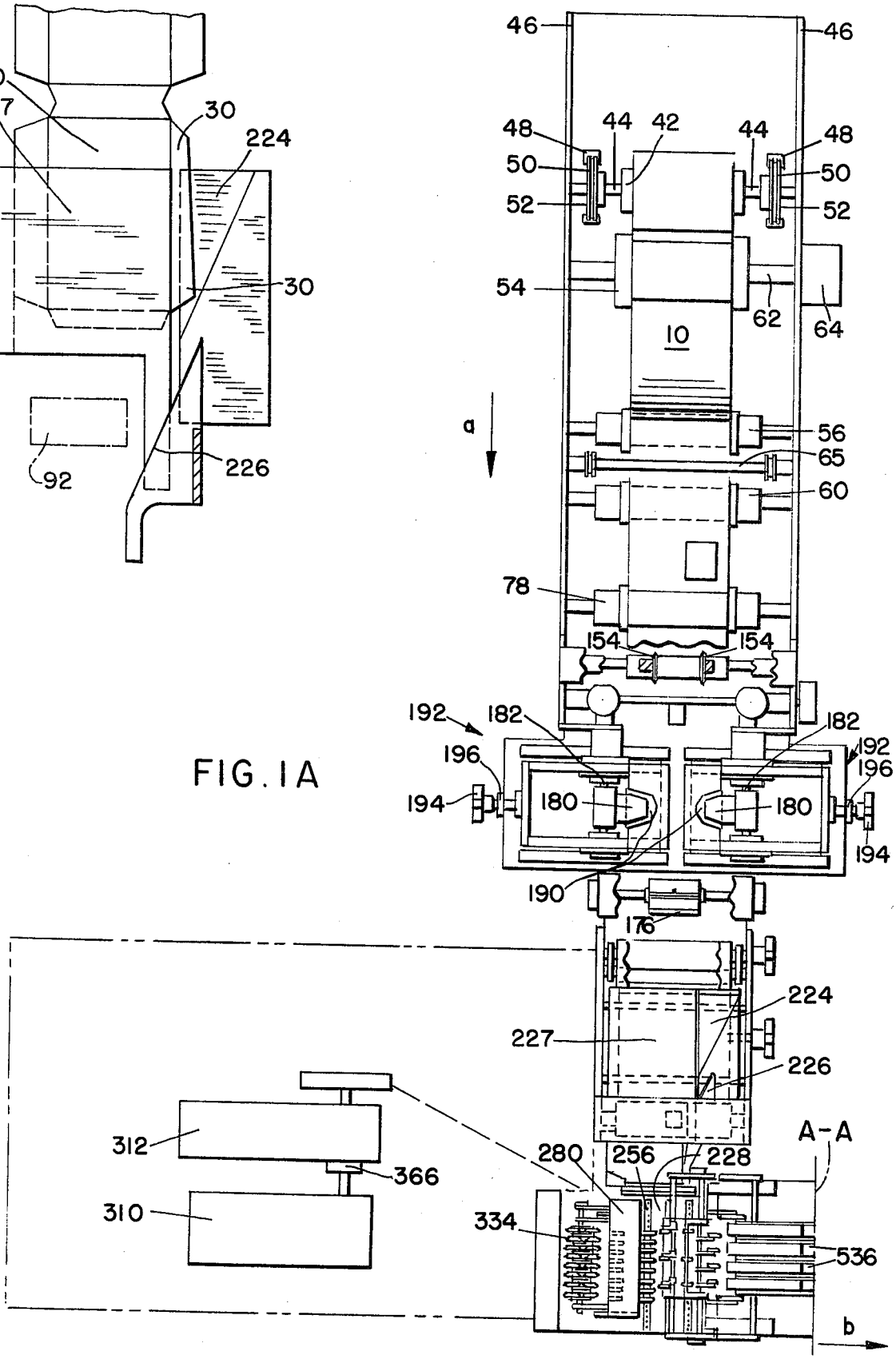
FIGS. 1A and 1B are top plan views which may be joined together along the common line A—A and generally show the mechanism for carrying out the invention.
Figure 2:
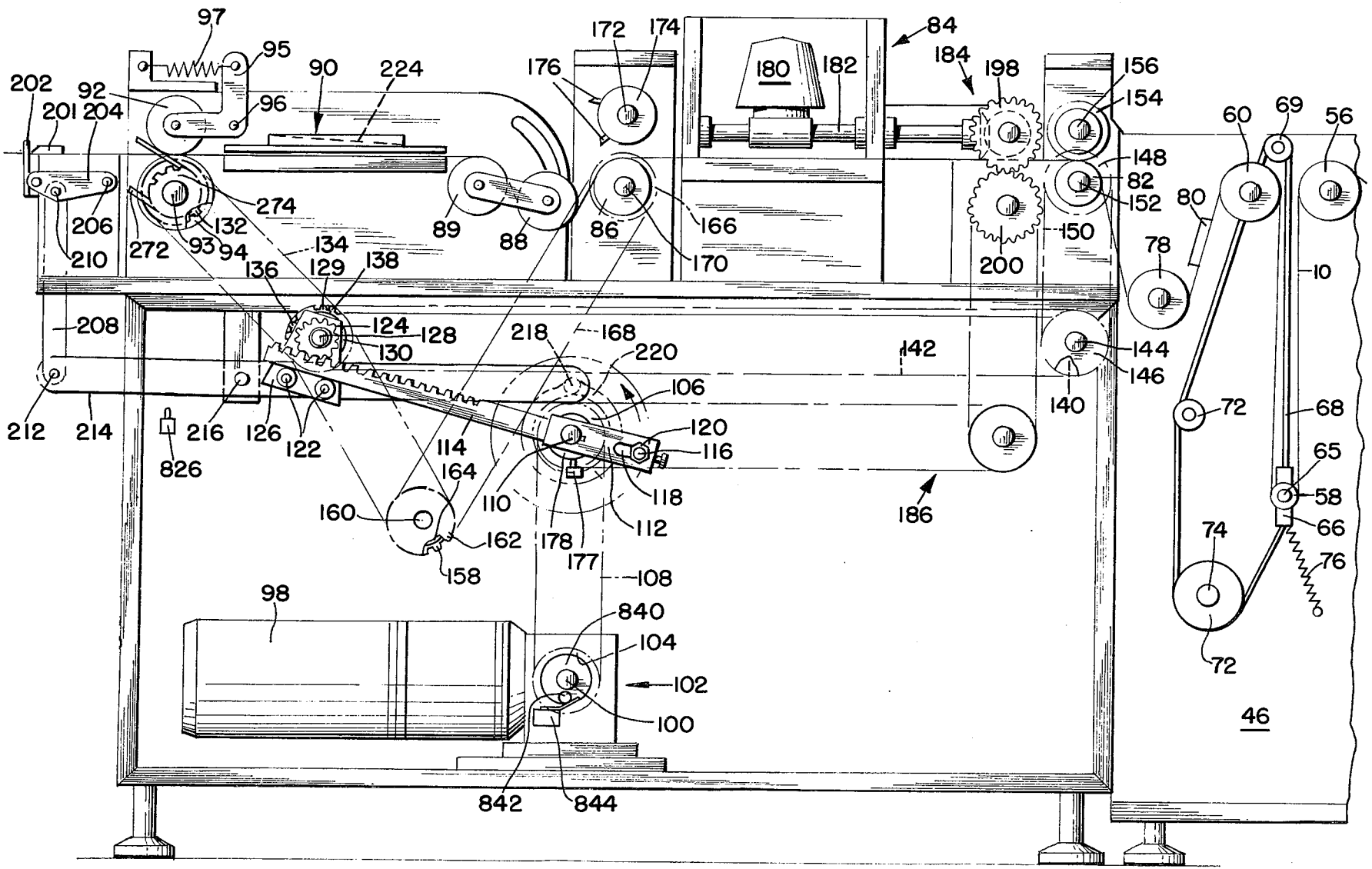
FIG. 2 is a side elevation of the paper web feeding elements.

Referring to FIGS. 1*a* and 2, the mechanism for forming the envelope blank and advancing the blank along the first path *a* is illustrated. The continuous paper web 10 extends from a supply roll 42 which is mounted on a shaft 44 journaled between sides 46 of the machine framework. Roll 42 is held against free rotation by conventional means such as weights 48, each supported by a brake belt 50 trained around a pulley 52 which is fixed to shaft 44. The web 10 extends under a drive roll 54, over an idler roll 56, under a dancer roll 58 and over an idler roll 60. Drive roll 54 is fixed to a shaft 62 which is driven by a motor 64 whereby roll 54 draws the web 10 from supply roll 42 at a continuous rate with the aid of pressure roll 43.

Dancer roll 58 is freely mounted on a shaft 65 which is mounted for vertical motion between sides 46. A block 66 is fixed to shaft 65. A belt 68 is fixed to the upper end of block 66 and extends upwardly over a pulley 69, downwardly around an idler pulley 70, under a lower pulley 72 and back upwardly where it is attached to the lower end of block 66. Lower pulley 72 is fixed to a shaft 74 mounted for rotation between sides 46. A reostat, not shown, is operatively connected to shaft 74 and controls the speed of motor 64. A spring 76 fixed to one of the machine sides 46 is attached to the lower end of block 66 and urges dancer roll 58 downwardly. A web 10 is drawn from idler roll 50 by the intermittent feed mechanism, to be described. Web material is drawn from the section of web extending downwardly to dancer roll 58 from idler rolls 60 and 56. If the web is drawn by the intermediate feed mechanism at a greater rate than it is drawn from supply roll 42 by drive roll 54, dancer roll 58 will be drawn upwardly. This will have the effect of turning shaft 74 counterclockwise as shown in FIG. 2. The reostat is connected to shaft 74 in such a manner as to cause motor 64 to increase in speed upon the counterclockwise turning of shaft 74. Conversely, if web 10 is being drawn from supply roll 42 at a greater rate than it is being drawn by the intermittent feed mechanism, dancer roll 58 will be drawn downwardly by spring 76 to take up the slack web. This will cause shaft 74 to rotate clockwise as viewed in FIG. 2. This will cause the reostat to slow down the motor 64. Although the web is drawn forwardly along first path *a* at an intermittent rate, the dancer roll and associated mechanism allows the web to be drawn continuously from the supply roll. Since the roll is quite heavy, particularly when it is full, continuous rotation thereof is much more desirable than an intermittent rotation even if the continuous rotation varies somewhat in the manner described above.

The web 10 extends forwardly along path *a* from idler roll 60 down to another idler roll 78. The portion of the web 10 which extends between rolls 60 and 78 maintains a spring loaded switch arm 80 depressed. If a break or tear should occur in the web 10, switch arm 80 will be urged to an open position and will be effective to stop the feed of the web 10 in a manner to be described.

Web 10 extends forwardly along path *a* from roll 78 over a first scoring roll 82 through a blanking station generally indicated by the reference numeral 84 and over a second scoring roll 86. Web 10 then extends under a roll 88, over a roll 89 along a first plow station generally indicated at 90 and between upper and lower feed rolls 92 and 94, respectively. Lower feed roll 94 is fixed to a shaft 93 which is rotated intermittently by means to be described. Upper feed roll 92 is mounted on a bell-crank lever 95 which is pivoted at 96. A spring 97 urges roll 92 into driving contact with roll 94.

The means for rotating lower feed roll 94 intermittently comprises a motor 98 which drives a shaft 100 through a brake and clutch gear reducer assembly generally indicated by the reference numeral 102. A sprocket 104 is fixed to shaft 100 and drives a sprocket 106 through a chain 108. Sprocket 106 is fixed to a main drive shaft 110 on which is keyed a crank arm 112. A toothed rack 114 is pivotably mounted on crank arm at 116 which pivot can be adjustably positioned along a slot 118 by loosening a nut 120. The position of pivot 116 with respect to the center of shaft 110 will determine the effective throw of the toothed rack 114. The forward or toothed end of rack 114 extends forwardly between guide rolls 122 and a gear 124 in driving engagement with gear 124. Guide rolls 122 are rotatably mounted on a block 126 which is freely mounted on a shaft 128 to accomodate the changing angular position of the rack 114. Gear 124 is fixed to shaft 128. A sprocket 129 is freely mounted on shaft 128 and is drivenly connected to gear 124 through a "one way clutch" 130. A sprocket 132 is fixed to shaft 93 and is driven by sprocket 129 through a chain 134. "One way clutch" 130 allows sprocket 129 to be rotated only during the rearward stroke of toothed rack 114 (to the right as viewed in FIG. 2) and is idle during the forward stroke of the rack. This causes the lower feed roll 94 to rotate only counterclockwise as viewed in FIG. 2 during the rearward stroke of the rack 114. During each period of rotation of the feed roll 94, a predetermined length of web 10 will be advanced along the first path *a*. This length will be determined by the envelope size which is desired and for different envelope sizes, pivot 116 will be adjusted within slot 118 to vary the effective stroke of the crank arm which will vary the throw of rack 114 which will, in turn, vary the amount of rotation of lower feed roll 94.

Additional sprockets 136 and 138 are fixed to shaft 128. Sprocket 136 drives sprocket 140 by means of a chain 142. Sprocket 140 is fixed to a shaft 144 on which is fixed a sprocket 146 which in turn drives a sprocket 148 by means of a chain 150. Sprocket 148 is fixed to a shaft 152 on which is also fixed previously described roll 82. A pair of spaced scoring wheels 154 are fixed to a shaft 156 and their outer sharp edged peripheries are in functional contact with roll 82. Annular grooves are formed in roll 82 where scoring wheels 154 contact the roll 82. As shaft 128 is rotated for intermittently rotating lower feed roll 94 to advance a length of paper web, roll 82 is simultaneously rotated with wheels 154 to form the long score lines 24 and 25 shown in FIG. 3 as the web is advanced along first path *a*.

Sprocket 138 drives a sprocket 158 which is freely mounted on a shaft 160. A sprocket 162 is also freely mounted on shaft 160 and is drivenly connected to sprocket 158 through a "single revolution clutch-brake unit" 164. Sprocket 162 drives a sprocket 166 by means of a chain 168. Sprocket 166 is fixed to a shaft 170 on which is also fixed previously described roll 86. Shaft 170 drives a shaft 172 by conventional drive means, not shown, on which is fixed a scoring wheel 174. A pair of scoring blades 176 extend from the outer surface of wheel 174. Since the "single revolution clutch-brake unit" 164 makes only one revolution for each drive stroke of toothed rack 114, scoring wheel 174 will also make one revolution. During the revolution of the scoring wheel 174, the scoring knives cooperate with the outer surface of roll 86 to form the shorter cross score lines 33 during the advance of the paper web by feed rolls 92 and 93. The controls for the "single revolution clutch-brake unit" 164 includes a switch 177 which is actuated by a cam 178 mounted for rotation with main drive shaft 110. Actuation of switch 177 causes unit 164 to drivingly engage sprockets 158 and 162 for a single revolution. Since main drive shaft 110 makes one revolution for each feed cycle of the paper web 10, cam 178 will actuate switch 177 once for each feed cycle of the paper web. Therefore, wheel 174 will make one revolution for each feed cycle of the paper web and the scoring blades 176 will form the short score lines at the same position along each length of paper web which is advanced. Wheel 174 will stop on the same position after each revolution of the "single revolution clutch-brake unit" 164.

The blanking station 84 is located between first and second scoring rolls 82 and 86 and includes a male blanking die 180 on each side of the paper web 10. The male dies 180 are fixed to shafts 182 which rotate in opposite directions by means of appropriate gearing generally indicated by the reference numeral 184. This gearing is in turn driven from the main drive shaft 110 through a chain and sprocket drive generally indicated by the reference numeral 186. Located below male dies 180 are a pair of female dies 190, see FIG. 1A, which are located on opposite sides of the paper web 10 in cooperating alignment with male dies 180. The paper web extends over the female dies 190 and shafts 182 are rotated so that the male dies 180 move toward each other and downwardly through their respective female dies 190. The drive from main drive shaft 110 to shafts 182 is such that the shafts 182 make one rotation for each rotation of main drive shaft 110. For each advance of the paper web 10, the male dies 180 will make one pass through their respective female dies 190 and thereby form the notches 29 as shown in FIG. 3. However, the male dies 180 are positioned on shafts 182 so that the notches 29 are formed when the paper web 10 is stationary.

The scoring wheels 154 are adjustably mounted on shaft 156 along the longitudinal axis thereof to accommodate different sized envelopes. The male and female dies 180 and 190 are mounted on assemblies indicated at 192 in FIG. 1A which can be moved toward and away from the web 10 by turning adjusting wheels 194 which bear against fixed brackets 196. The assemblies include shafts 182 and some of the gearing 184 which includes a pair of upper gears 198 which will move laterally with respect to respective lower gears 200 which are part of the gearing 184 but not the assemblies 192. Gears 198 and 200 are sufficiently wide to permit lateral relative movement and still maintain driving engagement.

The means for severing the envelope blanks after each advance of the paper web along the first path *a* includes a stationary blade 201 located above web 10 and cutoff blade 202 which is mounted on one end of a lever 204 which is pivoted at its opposite end at 206 on frame 46. The upper end of a vertical link 208 is pivotally connected at a point 210 which is spaced from pivot point 206. The lower end of link 208 is pivotally connected at 212 to the foward end of a horizontal lever 214 which is pivotally mounted on a stationary shaft 216. The rearward end of horizontal lever 214 has mounted thereon a follower 218 which rides in the track of a track cam 220 rotatably mounted on drive shaft 110. Cam 220 is effective to raise cutoff blade 202 from a position below web 10 to a point above the web so that the cutting edge of the blade 202 cooperates with stationary blade 201 to severe the web. The timing of cam 220 insures that the web 10 is severed between each advance of the web.

For each advance of the web 10, long score lines 24 and 25 are formed by scoring wheels 154, notches 29 are formed by dies 180 and 190 and cross score lines are formed by scoring blades 176. After the web has been scored and notched, it advances through a first plow station indicated generally by the reference numeral 90 which includes an incline surface 224 and a lip 226 which extends above the web. The main body of the web passes under a plate 227 and the bottom flap 30 rides up surface 224 which folds it to a vertical position. As the web is continued to be advanced it passes under lip 226 and is folded to an acute angle with respect to the top surface of the web to form a pocket as shown in FIG. 14. Any conventional flap folding apparatus may be used at the first plow station 90 provided that the first long flap is only partially folded to form the pocket shown in FIG. 14.

Figure 4:
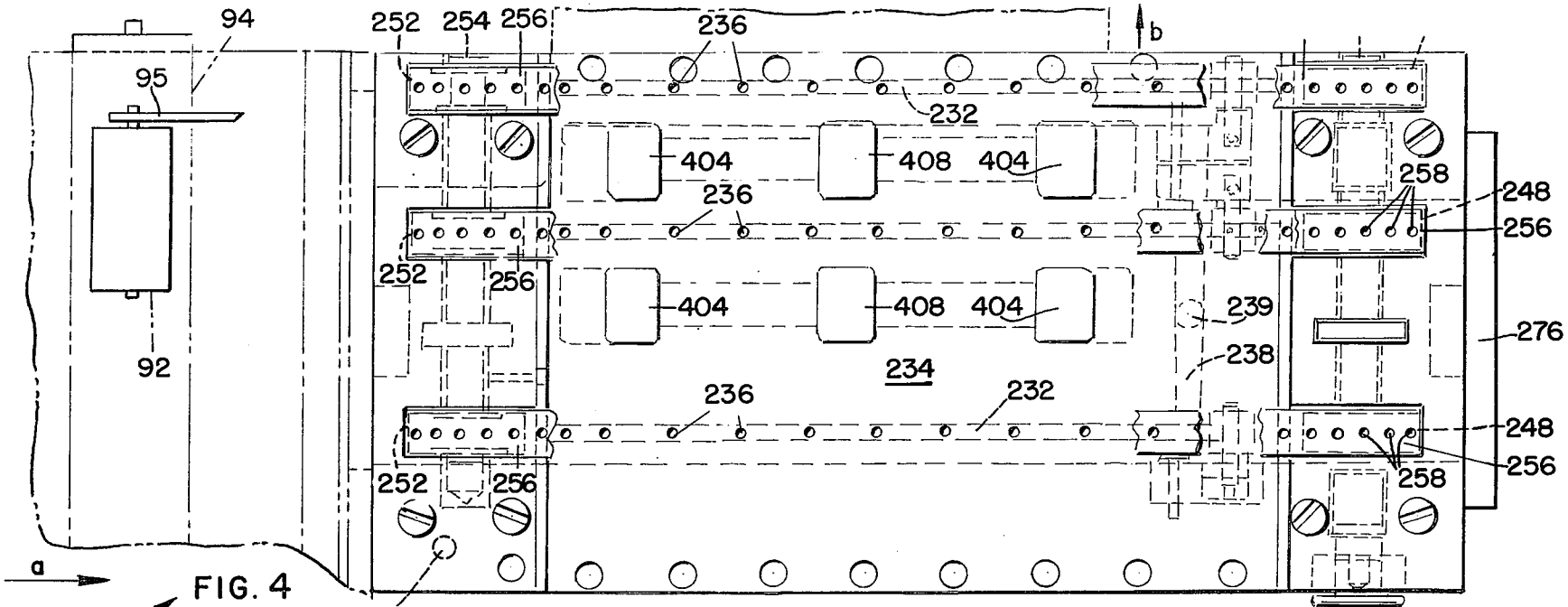
FIG. 4 is a fragmentary plan view of the vacuum housing which forms part of the inserting and first transfer station.
Figure 5:
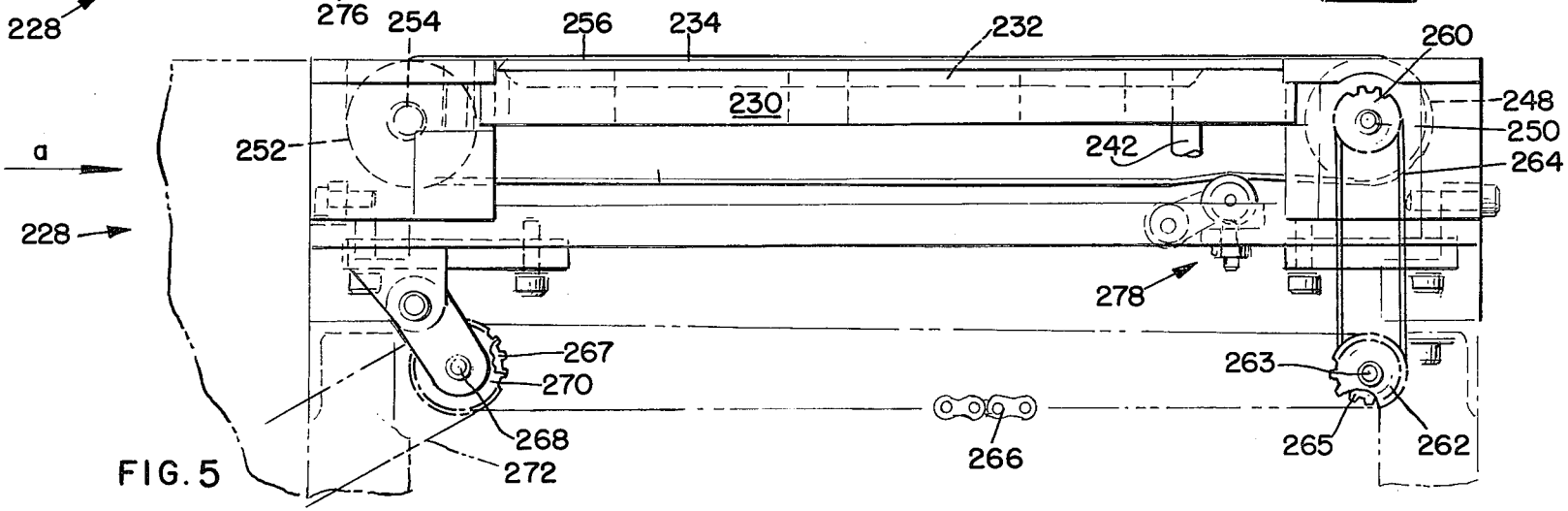
FIG. 5 is a view in side elevation of the vacuum housing of FIG. 4.

As the leading end of the web 10 passes through feed rolls 94 and 92 it enters the inserting and first transfer station generally indicated by the reference numeral 228, see FIGS. 1A, 4 and 5. Station 228 represents the end of the first path *a* and comprises a vacuum table housing 230.

Vacuum table housing 230 contains three parallel grooves 232 the longitudinal axis of which extend parallel to path *a* along the top of the housing. A cover 234 lies over the grooves 232 and contains apertures 236 which extend through the cover in alignment with the grooves 232. A main channel 238 interconnects all of the grooves 232 and has an outlet port 239 from which it is connected to a vacuum pump 240 by an air line 242, see also FIG. 10. A valve 244 located between port 239 and pump 240 separates the air line into two portions, one of which is connected to port 239 and the other of which is connected to pump 240. Pump 240 operates constantly to create subatomspheric pressure in line 242. Valve 244 is effective in a first position to connect both portions of air line 242 to create subatomspheric pressure in grooves 232 and effective in a second position to disconnect the two portions of line 242 and draw air from the atmosphere through a port 246.

Located at the forward end of housing 230 (the right hand end as viewed in FIG. 5) are drive pulleys 248 mounted for rotation on a shaft 250. Driven pulleys 252 are mounted for rotation on a shaft 254 at the rearward end of housing 230. Pulleys 252 and 248 are aligned along the longitudinal axes of grooves 232 and are drivingly interconnected by endless belts 256 which contain apertures 258. The upper runs of the belts 256 extend over the cover 234 so that the apertures 258 lie in the same vertical planes as the apertures 236. The drive for pulleys 248 include a sprocket 260 fixed to shaft 250 which is driven from a lower sprocket 262 by a chain 264. Sprocket 262 is keyed to a shaft 263 in which is keyed another sprocket 265. Sprocket 265 is driven by a chain 268 from a sprocket 267. Sprocket 267 is keyed to a shaft 268 on which is also keyed a sprocket 270 which is driven by a sprocket 274 through a chain 272. Sprocket 274 is fixed to the lower drive roll shaft 93, see FIG. 2. Since the drives for the feed roll 94 and pulleys are interconnected as described, belts 256 will be driven simultaneously with roll 94. Pulleys 248 are driven clockwise as viewed in FIG. 5 so that the upper runs of belts 256 move forwardly along path *a*. As the apertures 258 in belts 256 pass over apertures 236 in cover 234, suction is created in apertures 258 since at this time valve 244 is in its first position for creating subatomospheric pressure in grooves 232.

As the leading edge of the web passes forwardly of rolls 92 and 94 and over belts 256, the bottom surface of the web is drawn to the belts by the suction created through apertures 258. The forward movement of the belts 256 draws the leading end of the paper web 10 forwardly of the rolls 92 and 94. In this way, the leading end of the web 10 is always positively controlled during each feed cycle along path *a*. At the end of a feed cycle, the leading edge of the web 10 is at the forward end of the inserting and first transfer station against a stop 276 which insures that the web will be properly positioned at this station. Adjustable belt tensioning means generally indicated by the reference numeral 278 are deployed beneath the lower runs of belts 256 to keep them taut.

CHARGING INSERT MATERIAL INTO ENVELOPE BLANK

Figure 6:
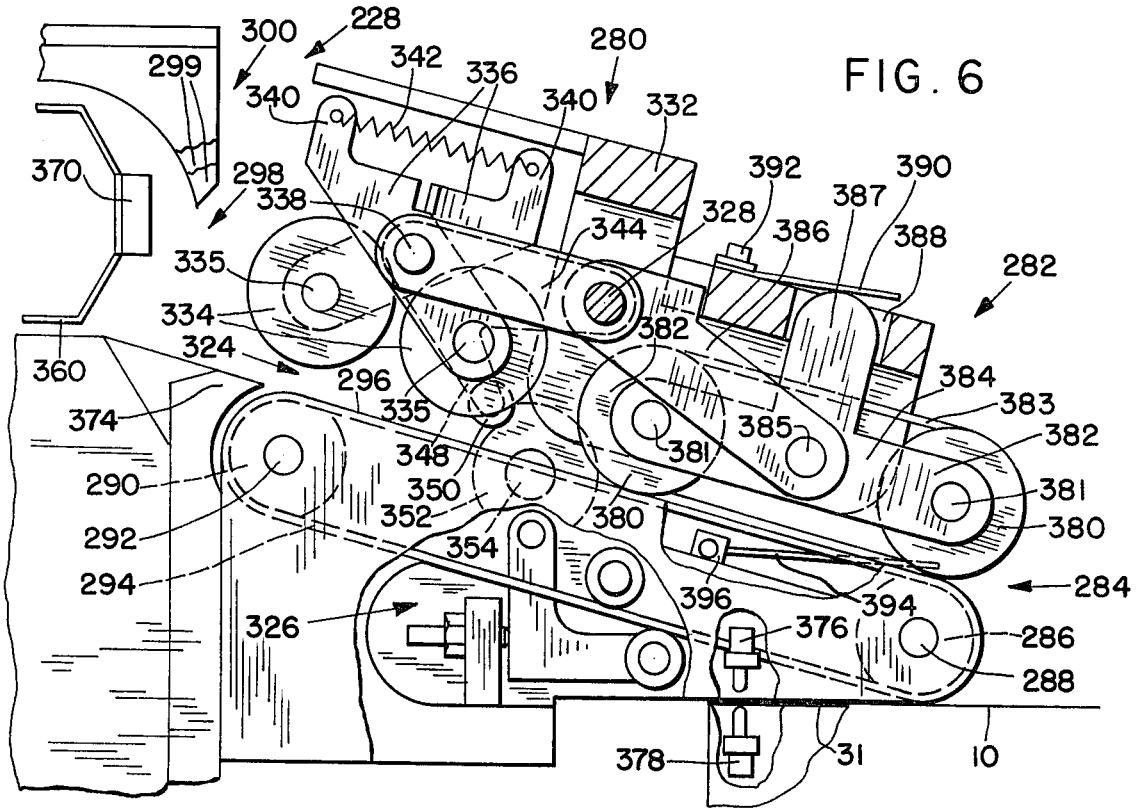
FIG. 6 is a fragmentary elevation of the apparatus for inserting the insert material.
Figure 7:
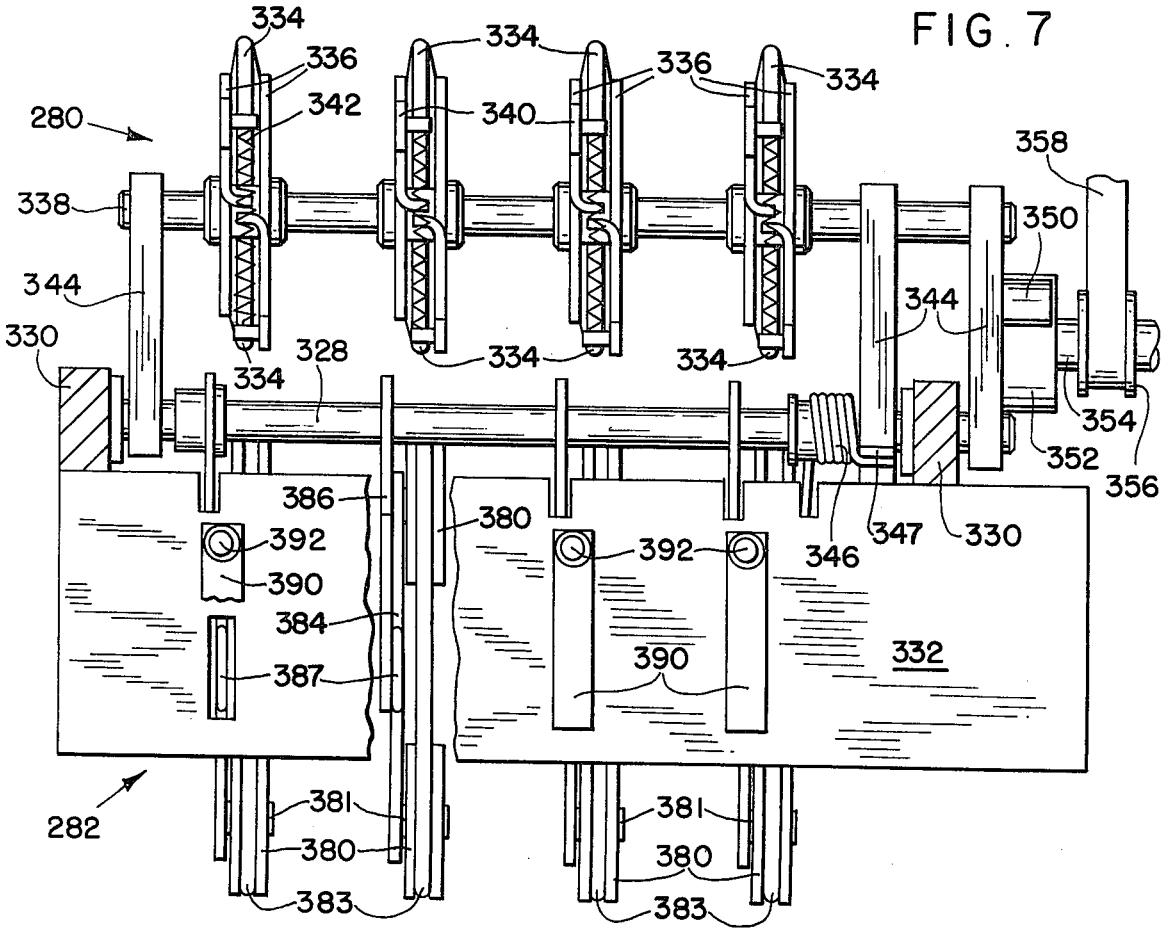
FIG. 7 is a plan view of the apparatus shown in FIG. 6.

The apparatus for charging insert material into the envelope blank at the inserting and first transfer station 228 is shown in FIGS. 1A, 6, 7, 8 and 12 through 15. Referring particularly to FIGS. 1A, 6 and 7, the material inserting apparatus is generally indicated by the reference numeral 280 and includes an upper pressure assembly generally indicated by the reference numeral 282 and a lower feed assembly generally indicated by the reference numeral 284. Inserting apparatus 280 is located adjacent the inserting and first transfer station 228 as illustrated in FIG. 1A.

Lower feed assembly includes a plurality of drive pulleys 286 fixed to a shaft 288 and a plurality of driven pulleys 290 rotatably mounted on a shaft 292. Belts 294 drivingly interconnect drive pulleys 286 to respective driven pulleys 290 so that the top runs thereof indicated by the reference numeral 296 extend at a declining angle from the exit end opening 298 formed by spaced guide bars 299 of an insert collating mechanism 300 to first transfer station 228.

The drive for shaft 292 is generally indicated by the reference numeral 302 and includes a pulley 304 loosely mounted on a shaft 306. Pulley 304 is rotated constantly by a belt 308 which extends from a motor 310 which forms part of the collator drive mechanism, not shown, but generally indicated by the reference numeral 312 in FIG. 1*a*. Pulley 304 drives a pulley 314 through an electromechanical clutch 316 upon energization of clutch 316. Pulley 314 drives a pulley 381 by means of a belt 322. Pulley 318 is fixed to shaft 288 and is effective to rotate shaft 292 clockwise as viewed in FIG. 6 so that the upper runs 296 of belts 294 travel in the direction of arrow 324. Adjustable belt tensioning means generally indicated at 326 are employed to maintain pressure against the lower runs of belt 294 to keep the belts taut.

Upper pressure plate assembly 282 includes a shaft 328 journaled at each end in brackets 330 of a fixed support 332. Located above each belt 296 adjacent exit end 298 of the collator 300 is a pair of rolls 334 mounted for free rotation on pivots 335 at the lower ends of a pair of levers 336. Levers 336 of each pair cross and are pivotally mounted on a shaft 338 in scissor-like fashion. The upper ends 340 of each pair of levers 336 are biased toward each other by a spring 342 which has the effect of urging the members of each pair of rolls 334 toward each other. Shaft 338 is supported by the rearwardly extending ends of levers 344 (to the left as viewed in FIG. 6). The forwardly extending ends of levers 344 are fixed to shaft 328. A torsion spring 346 mounted on shaft 328 bears against an upwardly extending abutment 347 of one of the levers 344 and is effective to urge rolls 334 toward belts 294. The lever 344 which is shown to the extreme right in FIG. 7 has a downwardly extending projection 348, see FIG. 6. A follower 350 is pivotally mounted on projection 348 and engages a cam 352 keyed to a drive shaft 354. A pulley 356 is fixed to drive shaft 354 and is driven by a belt 358 which is in turn driven from the collator drive 312 in timed relationship with a conveyor 360 of the collator 300.

Figure 8:
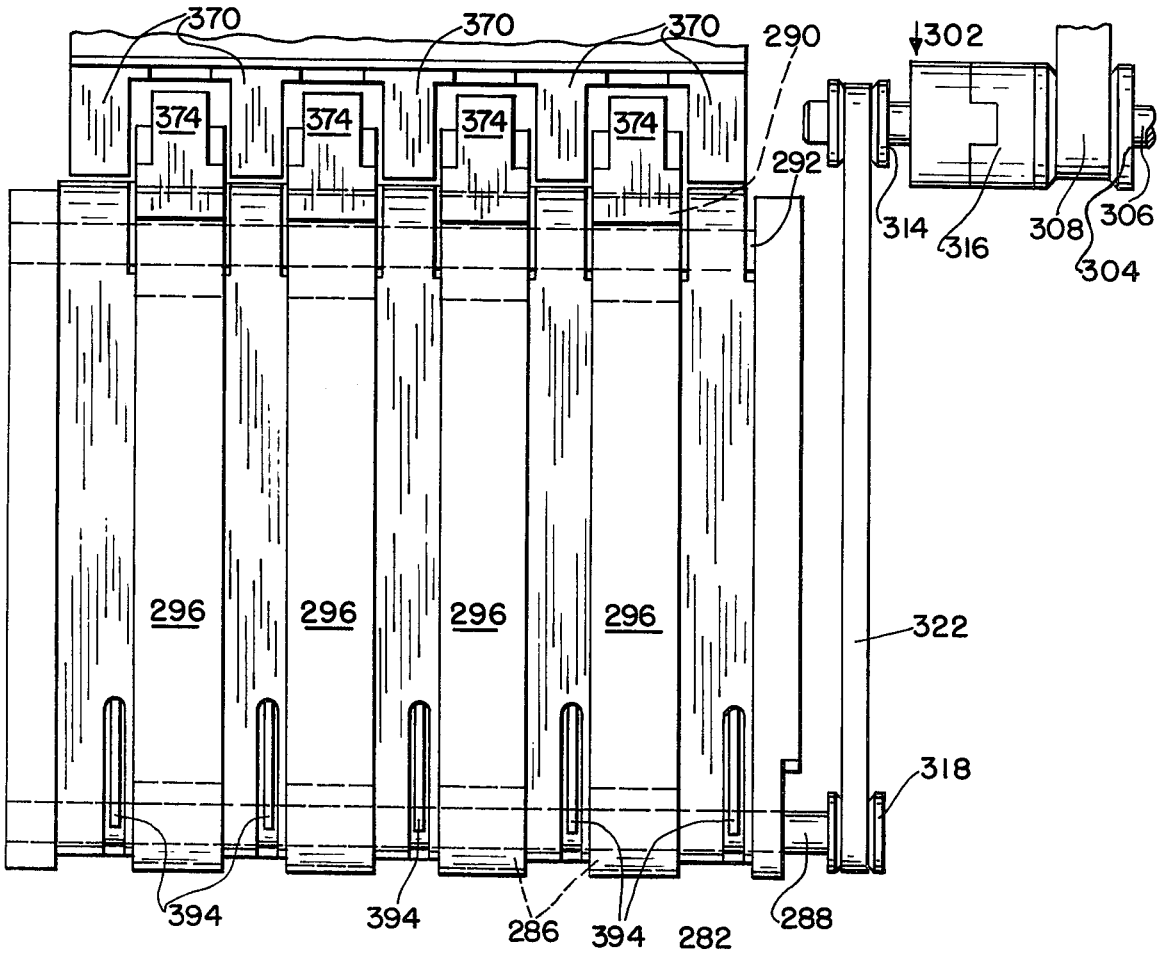
FIG. 8 is a plan view of the lower portion of the apparatus shown in FIG. 6.
Figure 9:
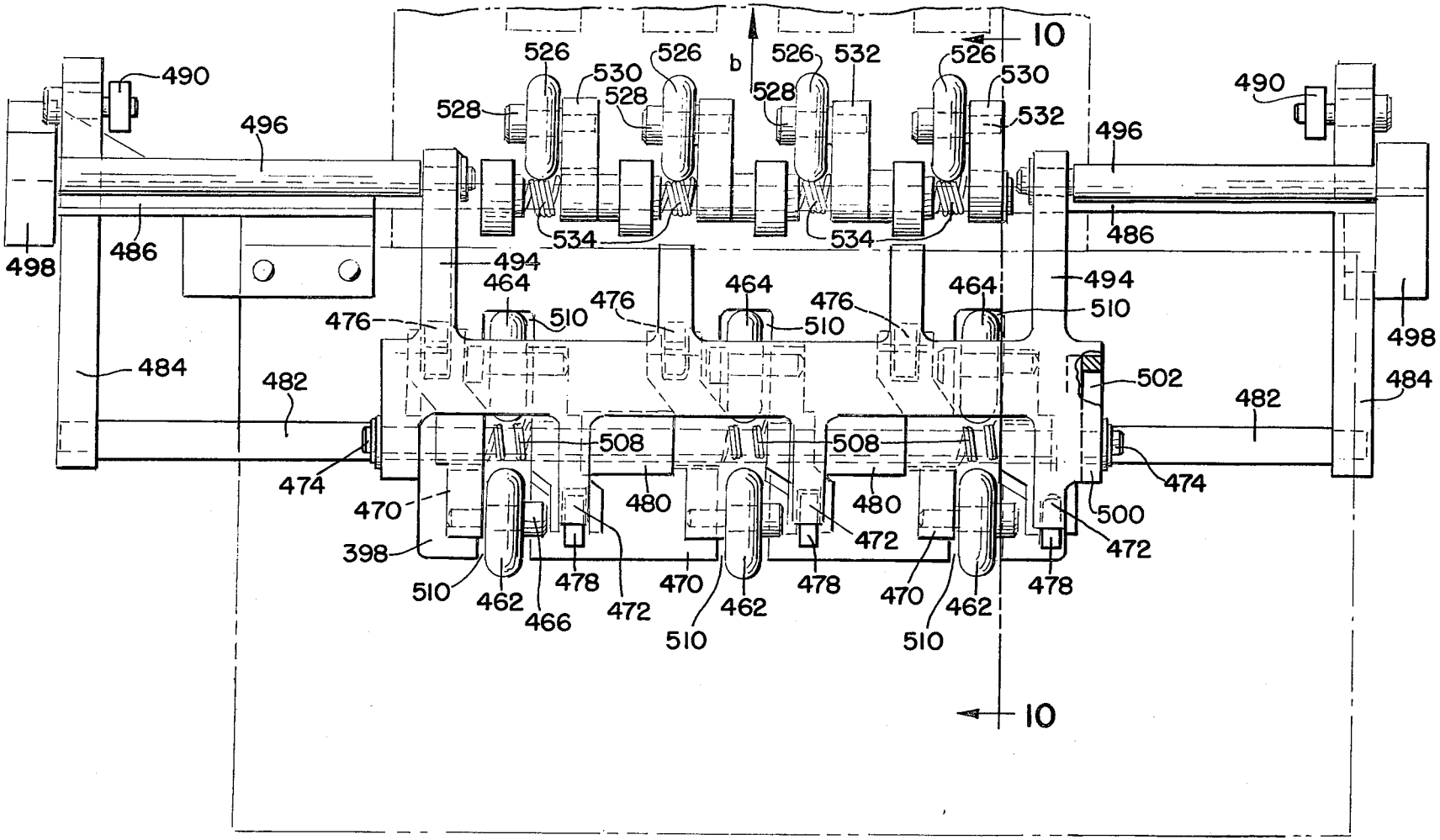
FIG. 9 is a fragmentary plan view of the upper portion of the mechanism for transferring a charged envelope from the inserting and first transfer station.
Figure 12:
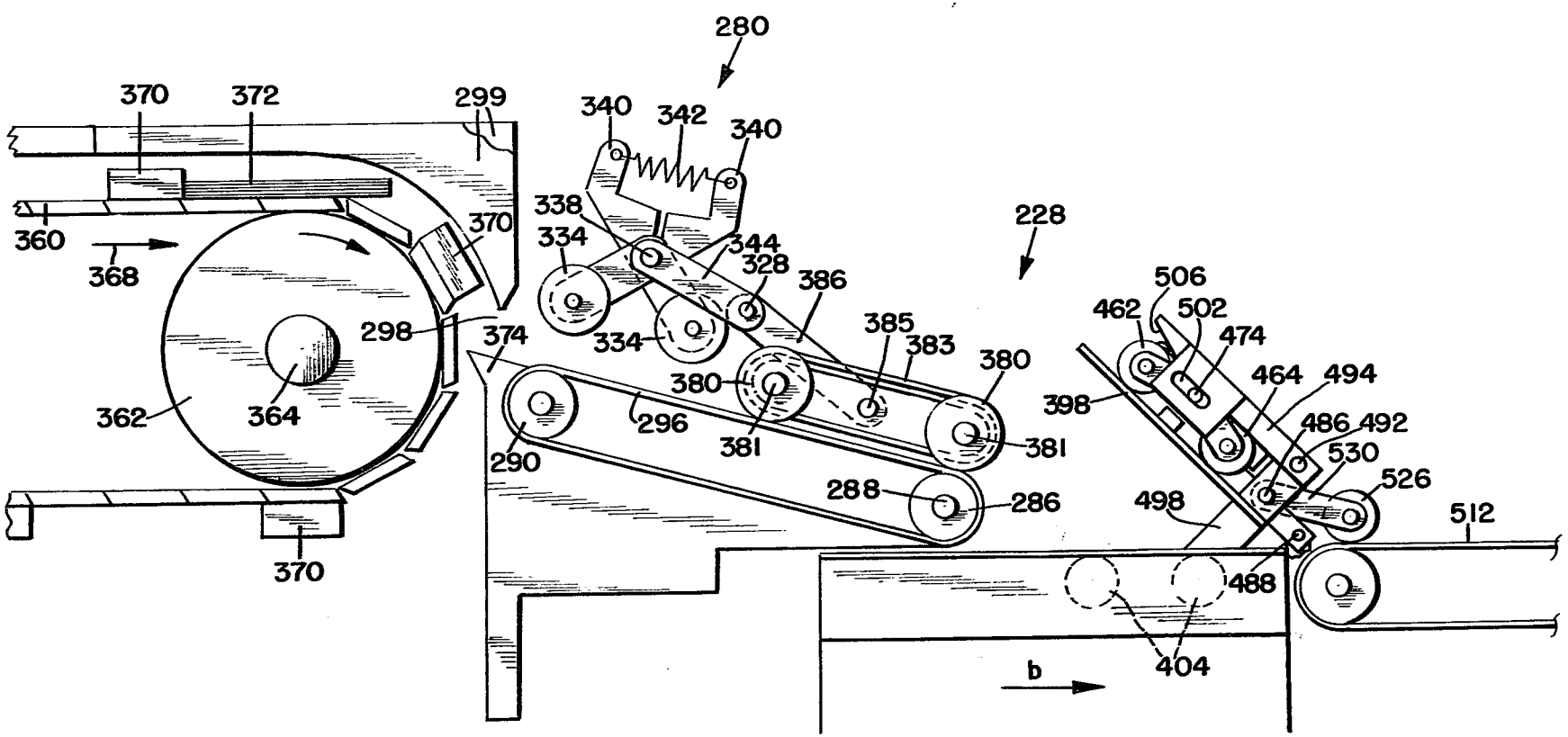
FIG. 12 is a fragmentary side elevation showing portions of the collator inserting apparatus and the transfer apparatus shown in FIG. 10 showing the inserting apparatus in position to receive a charge of insert material from the collator.
Figure 13:
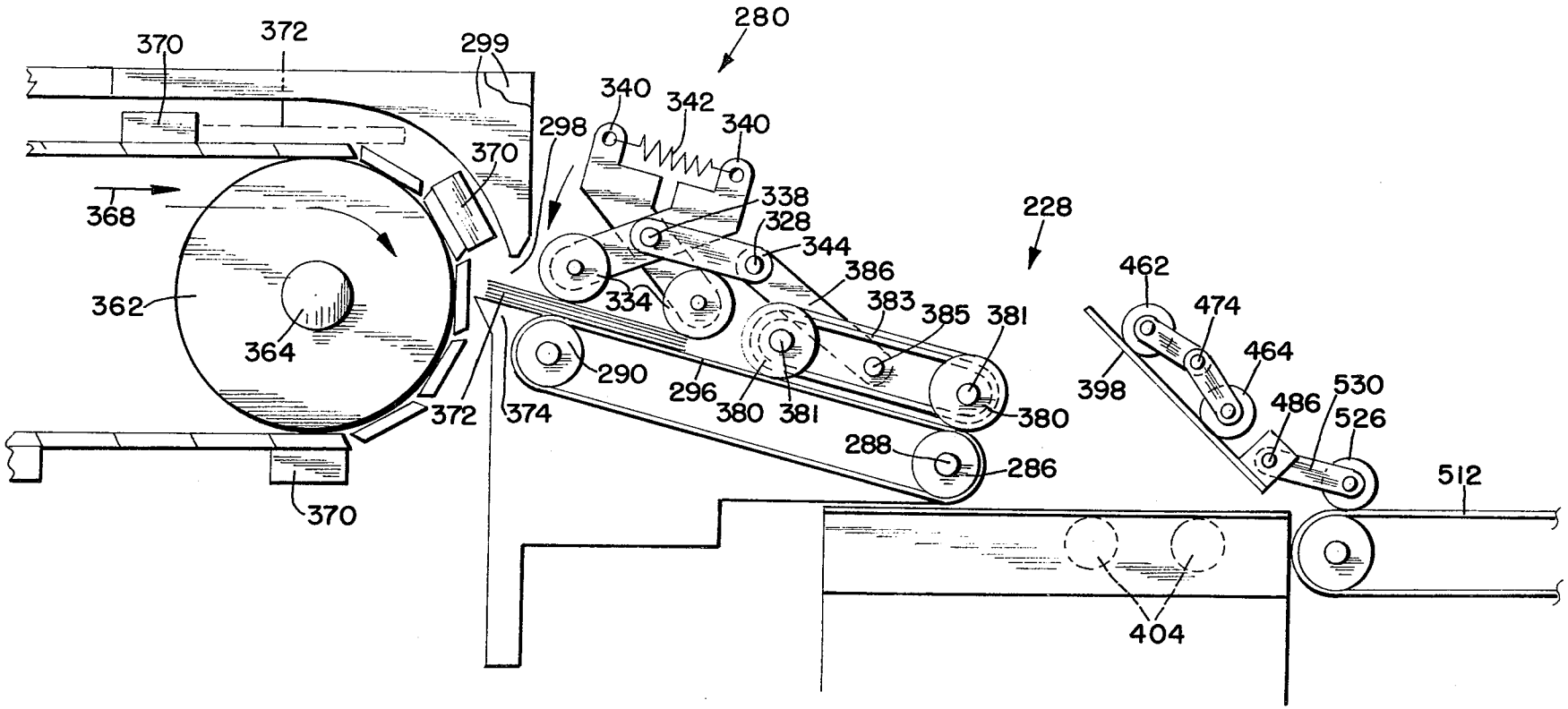
FIG. 13 is a view similar to FIG. 12, showing the insert material in ready position within the inserting apparatus.

Referring particularly to FIG. 12, conveyor 360 is trained around a pulley 362 driven by a shaft 364 which is in turn driven from motor 310 through drive mechanism 312 which includes a one rotation clutch 366. Energization of clutch 366 causes the conveyor 360 to advance along a path indicated by arrow 368. Conveyor 360 includes pusher fingers 370 which are effective to advance a charge of insert material 372 along path 368, around pulley 362 and through opening 298. Pusher fingers 370 are arranged in transverse rows and are spaced from each other within the rows. Spaced guides 374 are arranged across the bottom of opening 298 and offset with respect to the pusher fingers 370 so that as the fingers pass by opening 298 they will pass between guides 374 as shown in FIG. 8. Shaft 354 is also driven from one rotation clutch 366 so that cam 352 is driven in timed relation with conveyor 360. Cam 352 is effective to lift follower 350. As shown in FIG. 12 it consequently raises rolls 334 away from the upper runs 296 of belts 294 as the pusher fingers 370 push a charge of insert material 372 through opening 298 and beneath the rolls 334. Cam 352 will subsequently allow the rolls to descend into engagement with the charge of insert material 372 as illustrated in FIG. 13. This is the condition which precedes the advance of an envelope blank into the inserting and first transfer station 228. The fact that the rolls 334 of each pair are individually pivotable around shaft 338 allows the rolls to effectively engage a charge of insert material which has a variable thickness along its length.

As an envelope blank enters the inserting and first transfer station 228, the closure flap 31 will pass between a light source 376 and a photo-electric sensor 378 and interrupt a light beam from source 376. Through electrical control means to be described, interruption of this light beam causes sensor 378 to activate the collator 300 to prepare another charge of insert material and advance same toward the inserting apparatus 280 although with a slight delay as will be apparent from a description of the circuitry. Interruption of the light beam from light 376 will also cause clutch 316 to become energized to cause the upper runs 296 of belts 294 to be driven in the direction of arrow 324. This will cause the charge of insert material 372 to advance along path 324. After the charge 372 leaves rolls 334 they will continue to be advanced along path 324 by pairs of rolls 380 which are vertically aligned with belts 294. The rolls 380 of each pair are rotatably mounted on shafts 381 supported from the ends of horizontal portions 382 of a T shaped link 384. A belt 383 drivingly interconnects each pair of rolls 380. Each link 384 is pivotably connected at 385 to one end of a lever 386 the opposite end of which is pivotably mounted on shaft 328. Each link 384 has a vertically extending portion 387 which extends upwardly through a slot 388 in fixed support 332. A leaf spring 390 anchored at 392 to support 332 engages the portion 387 of each link 384 and urges rolls 380 and belt 383 into driven engagement with the upper runs 296 of belts 294. As the charge of insert material 372 is advanced from rolls 334 it passes under rolls 380 and is advanced between belts 383 and upper runs 296 as shown in FIG. 14 and discharged into the pocket formed by the bottom flap 30 of the envelope blank which is located at the inserting and first transfer station 228. Since links 284 are pivoted at their centers on swingable levers 386, pulley 380 can move together or independently away from upper runs 296 to accomodate variations in thickness of the charge of insert material and to maintain both pulleys 380 of each pair in driving engagement with upper runs 296 as the insert material is discharged as shown in FIG. 14.

As the charge of insert material 372 pass between belts 383 and upper runs 296, they depress arms 394 of a switch 396 which extend between belts 383 across the width of the inserting mechanism 280. In a manner to be explained more fully in a later section the depression of switch arms 394 initiates mechanism for transferring the charged envelope from the inserting and first transfer station 228. During charging of the envelope blank, it is held in the inserting and first transfer station 228 by the previously described vacuum means illustrated in FIGS. 4, 5 and 10. The bottom flap 30 of the envelope is also restrained by a flat plate 398 which forms part of the first transfer mechanism to be described. Plate 398 extends over the inserting and first transfer station 228 at the same angle as the bottom flap 30 and prevents the charge of insert material 372 from opening the bottom flap as it is discharged into the pocket formed by the bottom flap.

FIRST TRANSFER MEANS

After the leading envelope blank has been charged, it is transferred from station 228 by first transfer means illustrated in FIGS. 4 and 9 through 15. The first transfer means comprises an upper assembly and a lower assembly generally indicated by the reference numerals 400 and 402, respectively.

Lower assembly 402 comprises two rows of web advancing rolls 404 keyed to shafts 406, each row containing three rolls. The middle rolls 404 of each row are driven by a belt 408 which extends from a lower drive roll 410 around one on the rolls 404, down to an intermediate idler roll 412, back up to and around the other roll 404 and back to the lower drive roll 410. Rolls 410 and 412 are keyed to shafts 414 and 416, respectively which are journaled in a supporting block 418 which is slidably mounted for vertical movement in a groove 420 in vacuum table housing 230. Shafts 406 are alwo journaled in block 418.

The drive for belt 408 includes a pulley 421 fixed to shaft 414 which is driven from a pulley 422 by means of a belt 424. Pulley 422 is keyed to a shaft 426 on which is keyed a pulley 428 driven by a pulley 430 by means of a belt 432. Pulley 430 is driven by a motor 434. The upper end of block 418 which supports shafts 406 comprises a pair of U shaped brackets 435 and allows rolls 404 to extend into vertical openings 436 in vacuum table housing 230. Block 418 is pivotably supported at 438 on a pair of levers 440 each of which is pivotally mounted at one end on a fixed shaft 442. The opposite end of each lever 440 has a slot 444 within which rides a roll 446 of a follower adaptor 448. A barrel cam 450 mounted on a shaft 452 has a slot 454 within which rides a follower 456 of adaptor 448. Cam 450 is driven from motor 434 through conventional drive means generally indicated by the reference numeral 458 and through a one rotation electro-mechanical clutch 460. Energization of clutch 460 causes cam 450 to rotate to swing levers 440 between the full line and dotted line positions shown in FIG. 10. When levers 440 are in the full line position they are effective to lift block 448 to the upper position shown in FIG. 10 to bring the rolls 404 into engagement with the lower surface of the envelope blank in station 228 in driving cooperation with corresponding rolls of the upper assembly to be described. When levers 440 are in the dotted line position as viewed in FIG. 10, rolls 404 are lowered to a position below the cover 234 of the vacuum table housing 230.

Figure 10:
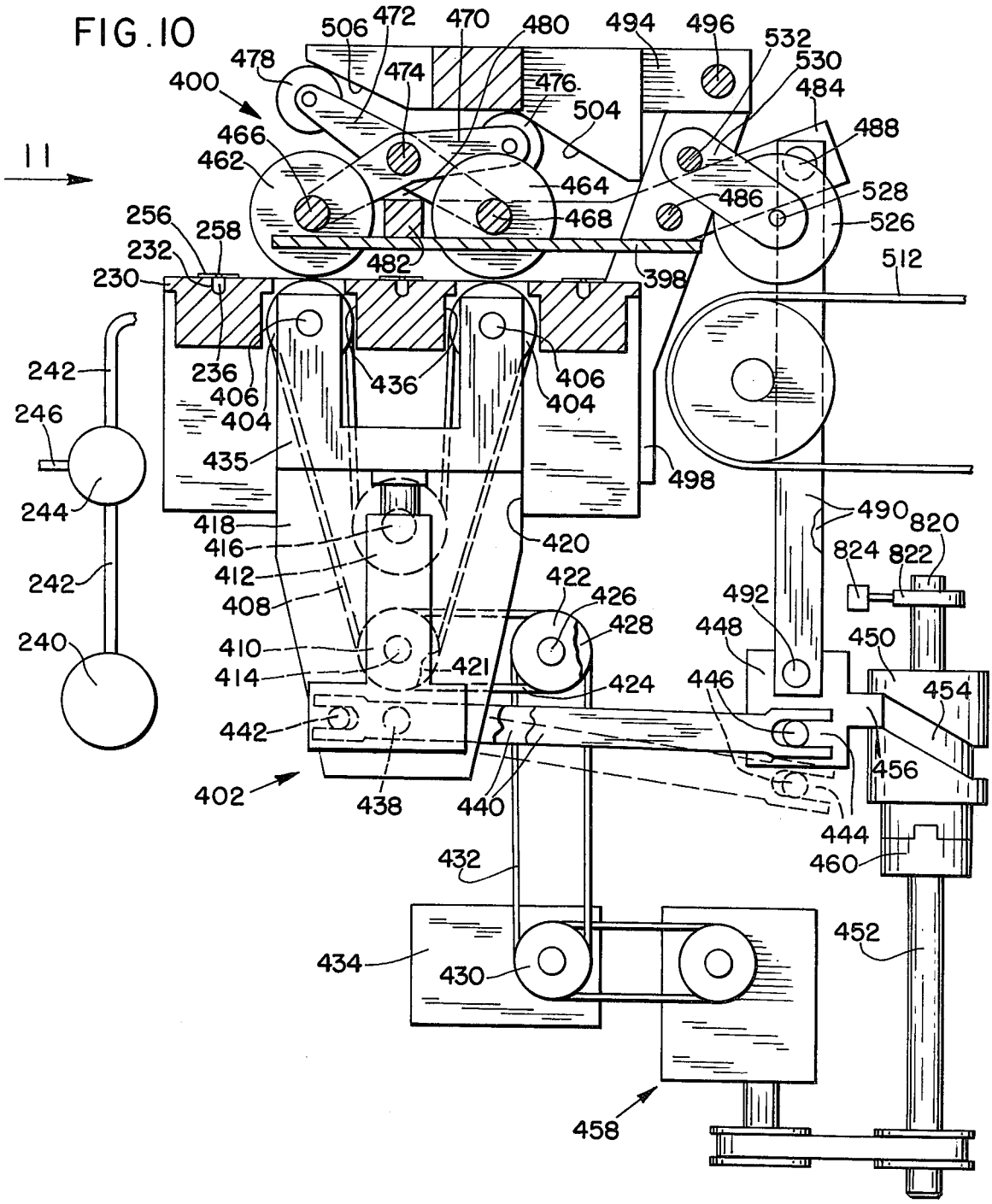
FIG. 10 is a vertical section taken along line 10—10 of FIG. 9, showing the upper and lower portions of the mechanism for transferring a charged envelope from the inserting and first transfer station.
Figure 11:
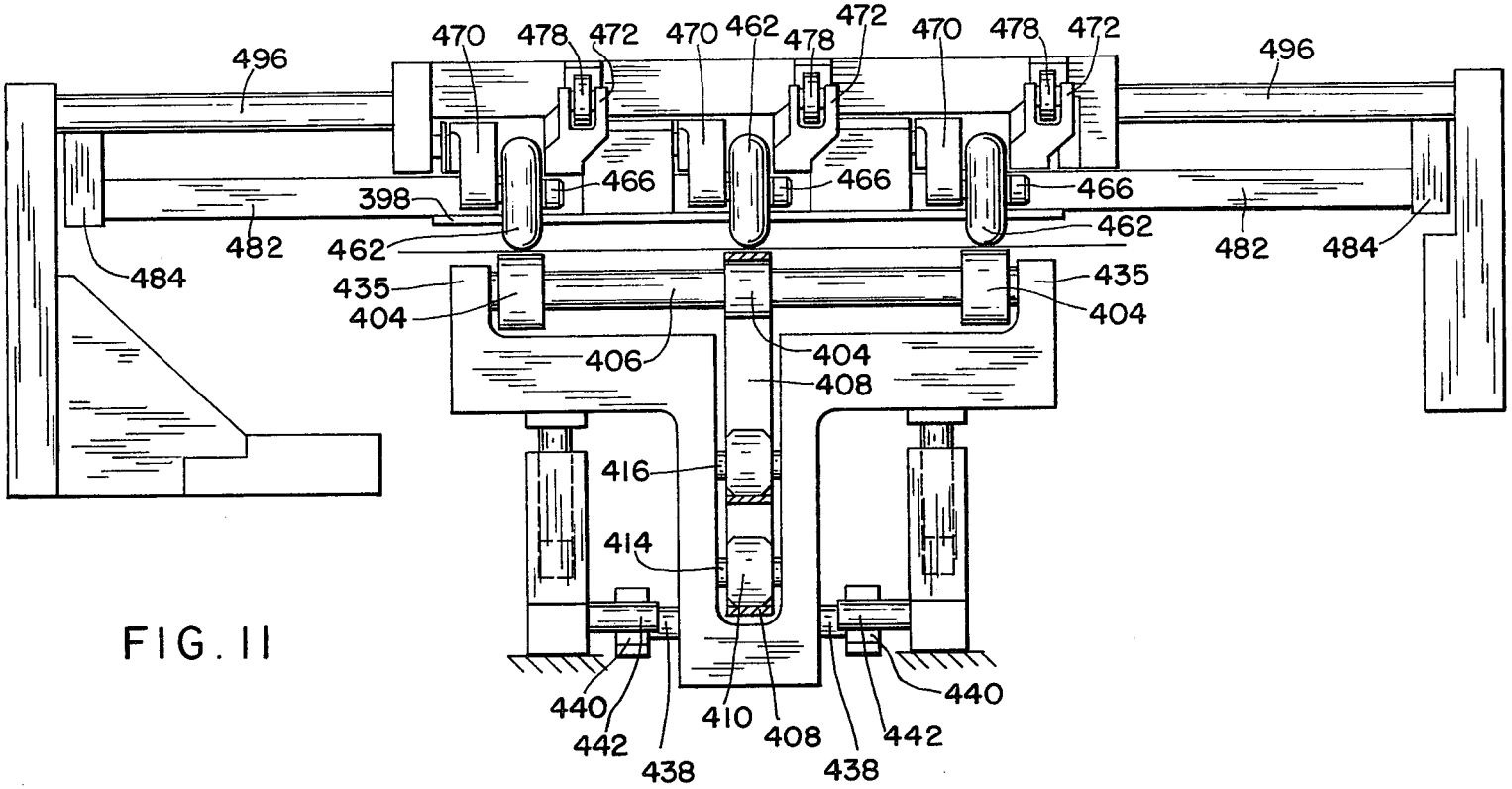
FIG. 11 is a rear elevation looking in the direction of arrow 11 of FIG. 10 with portions in section.

Upper assembly 400 comprises three pairs of wheels 462 and 464, each pair being rotatably mounted on stub shafts 466 and 468, respectively, which are supported at the lower ends of levers 470 and 472, respectively. All of the levers 470 and 472 are pivoted at the centers on a shaft 474. A follower roll 476 is rotatably mounted on the upper end of each lever 470 and a follower roll 478 is rotatably mounted on the upper end of each lever 472. Shaft 474 is mounted in brackets 480 which are supported on a horizontal bar 482 which extends across the entire width of upper assembly 400. Previously described plate 398 is mounted beneath bar 482 as shown in FIG. 10. The ends of bar 482 are supported at the ends of a pair of levers 484 which are pivotably mounted on fixed pivots 486. The opposite ends of levers 484 are pivotably attached at 488 to the upper ends of a pair of links 490. The lower ends of links 490 are pivotably connected at 492 to follower adaptor 448.

An upper plate 494 is pivotably supported on a pair of axially aligned shafts 496 which are supported by a pair of fixed supporting arms 498. Located on each side of upper plate 494 is a vertical plate 500 which contains a slot 502. The ends of shaft 474 extend through slots 502, see FIGS. 9 and 12. Upper plate 494 also includes a plurality of cam surfaces 504 and 506 which are vertically aligned with follower rolls 476 and 478 respectively. Torsion springs 508 mounted on shaft 474 bias levers 470 and 472 in opposite directions to maintain rolls 476 and 478 in following engagement with cam surfaces 504 and 506, respectively. Upward movement of links 490 causes plate 398 and shaft 476 to swing from the upper position shown in FIG. 12 to the lower position shown in FIGS. 10 and 15. The downward movement of shaft 474 causes upper plate 494 to also swing downwardly from shafts 496. Since shaft 486 is vertically spaced from shafts 496, upper plate 494 moves relative to plate 398 to the extent that the ends of shaft 474 slides along slots 502. This relative movement is from the right of slots 502 to the left thereof as viewed in FIG. 12 when the plates 398 and 494 are moved downwardly. Therefore, plate 494 moves to the right relative to plate 398 as viewed in FIG. 10 so that follower rolls 476 and 478 ride up the inclines of cam surfaces 504 and 506, respectively. This allows torsion springs 508 to lower rolls 462 and 464. Plate 398 contains slots 510 which allow rolls 462 and 464 to be lowered below the bottom surface of plate 398. Since levers 440 and links 490 are actuated simultaneously by follower adaptor 448, the upward movement of rolls 404 and downward movement of rolls 462 and 468 occur simultaneously to the cooperating position shown in FIGS. 10 and 15. Belt 408 is driven so that rolls 404 rotate clockwise as viewed in FIG. 10 and drive the charged envelope blank to the right, as viewed in FIG. 15, out of the inserting and first transfer station 228 to initiate the movement of the charged envelope blank along the second path indicated by the arrow *b*. Because levers 470 and 472 are individually movable and spring biased, variations in thickness of the charged envelope blank are accomodated.

MEANS FOR ADVANCING CHARGED ENVELOPE BLANK ALONG A SECOND PATH

The means for advancing the charged envelope blank 372 along the second path *b* are illustrated in FIGS. 15 through 19 and comprise an endless conveyor belt 512 trained around a pair of rollers 514 and 516. Roller 514 is keyed to a shaft 518 journaled in the machine framework. A pulley 520 is also keyed to shaft 518 and is driven constantaly by a belt 522 which is in turn driven by motor 434 through conventional gear reducing means. Roller 516 is keyed to a shaft 524 which is also journaled in the machine framework. Shaft 518 is rotated so that the upper run of belt 512 travels in direction *b*.

Figure 15:
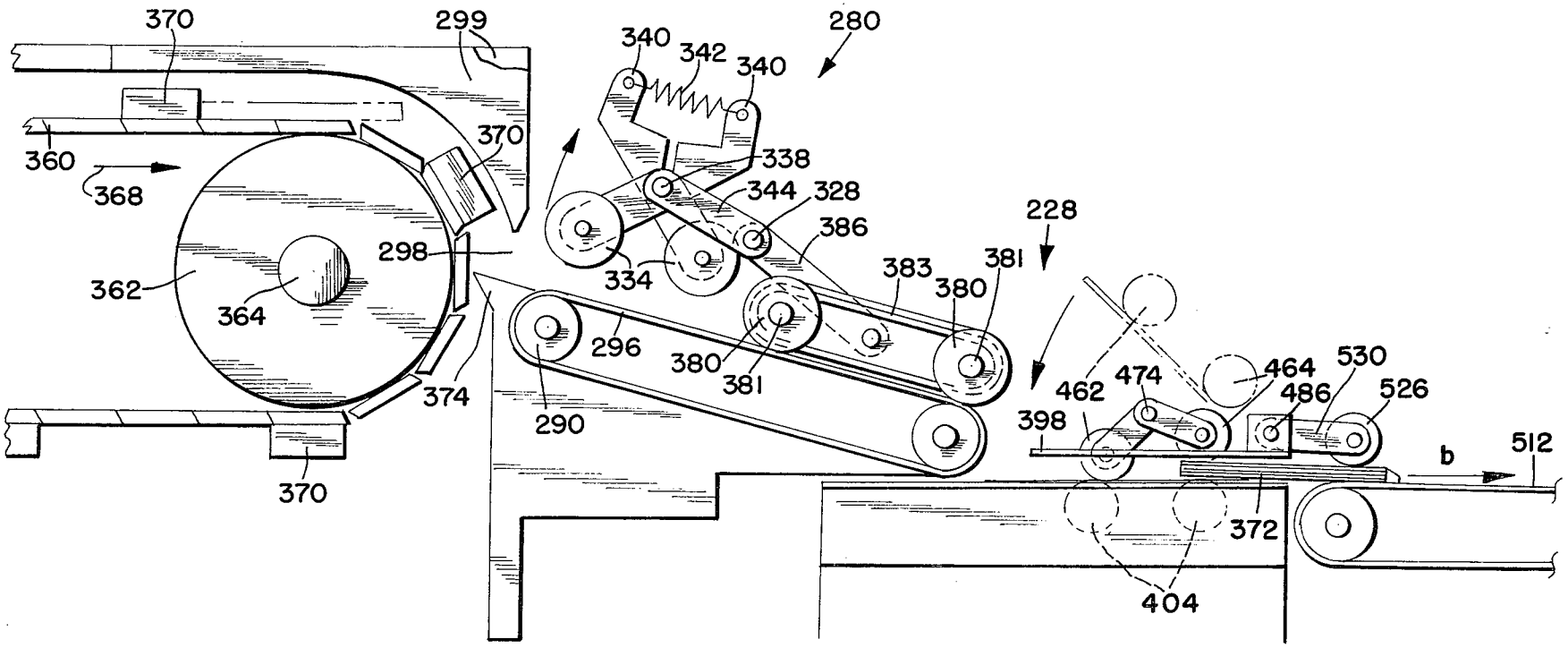
FIG. 15 is a view similar to FIG. 12 showing the charged envelope blank being transferred from the inserting and first transfer station.

As the charged envelope blank is transferred from station 228 the bottom flap 30 is pressed into overlying relationship with the charge of insert material 372 by the plate 398 and is maintained in the relationship as it passes onto belt 512 by a series of pressure rollers 526 as shown in FIG. 15. Rollers 526 are rotatably mounted on stub shafts 528 supported at the forward ends of levers 530, see FIGS. 15 and 9. The rearward ends of levers 530 are pivotably mounted on shaft 532. Torsion springs 534 bias levers 530 clockwise as viewed in FIG. 15 for urging rollers 526 toward belt 512.

Figure 16:
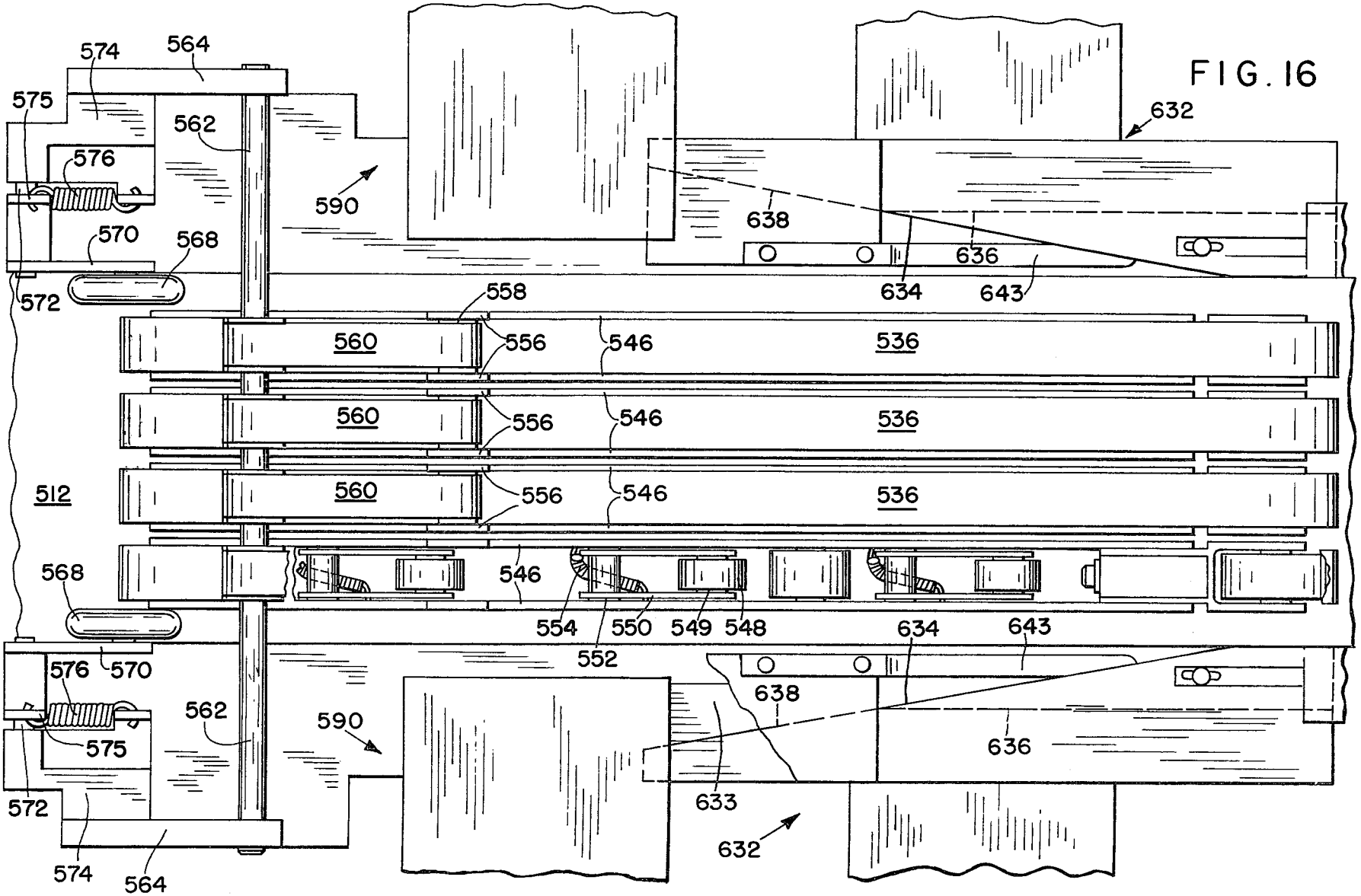
FIG. 16 is a fragmentary plan view of the means for advancing a charged envelope blank along the second path.
Figure 17:
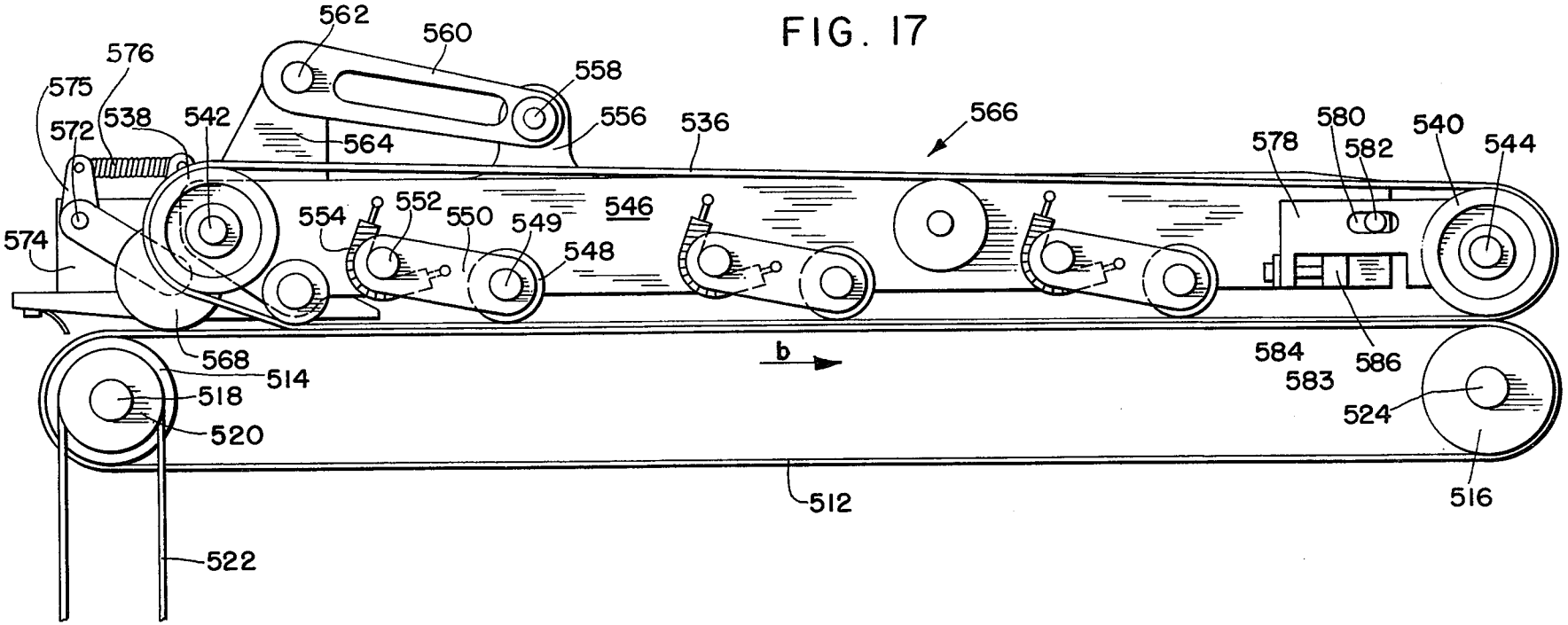
FIG. 17 is a side elevation of the apparatus of FIG. 16.
Figure 19:
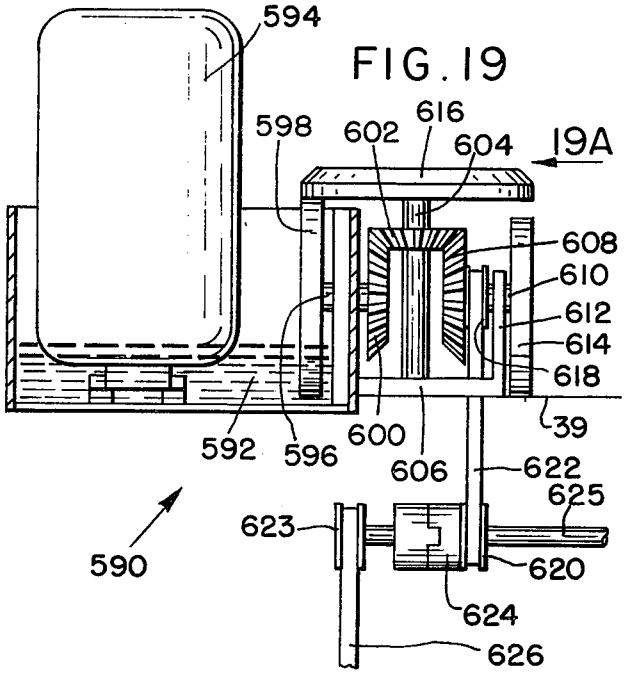
FIG. 19 is a vertical section taken along line 19—19 of FIG. 18, looking in the direction of the arrow.
Figure 18:
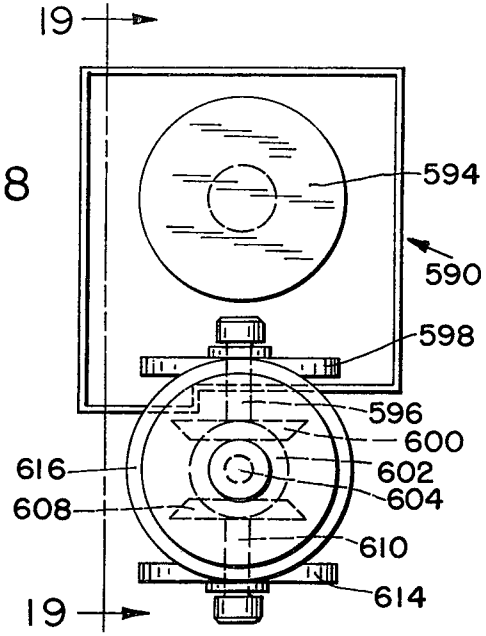
FIG. 18 is a plan view of a glue applying apparatus for one of the end flaps of the envelope blank.
Figure 19A:
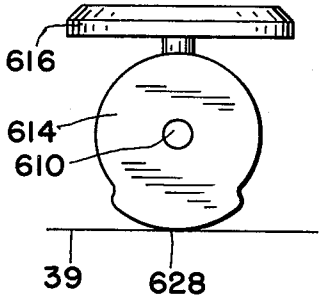
FIG. 19A is a view looking in the direction of arrow 19A of FIG. 19.

The charged envelop blank is maintained continuously pressed as it advances along conveyor belt 512 by a plurality of endless pressure belts 536 located above the upper run of belt 512, see particularly FIGS. 16 and 17. Belts 536 are trained around forward and rearward pulleys 538 and 540 mounted for rotation on shafts 542 and 544, respectively which extend through a pair of side plates 546 associated with each set of belts 536. Located within each belt 536 are a plurality of pressure rollers 548 which are rotatably mounted on shafts 549 which extend through the ends of pairs of levers 550. The opposite ends of the pairs of levers 550 are pivotably mounted on shafts 552 which are supported by side plates 546 and extend therebetween. Springs 554 urge levers 550 clockwise as viewed in FIG. 17 and maintain the lower run of belts 536 in driving contact with belt 512. Each pair of side plates 546 has a pair of upwardly extending brackets 556 which support a pivot rod 558 on which is pivotably mounted one end of a link 560. The opposite end of each link 560 is pivotably mounted on a shaft 562 which is supported by brackets 564 which are fixed to the framework of the machine. Each belt 536 and its corresponding side plates 546 together with associated pressure rolls 548 forms an upper pressure assembly generally indicated by the reference numeral 566. Each assembly 566 is individually pivoted at its corresponding pivot rod 558 and shaft 562 to enable the assembly to yieldingly maintain pressure against the upper run of belt 512. It can be seen therefore that the main pressure from assemblies 566 comes from the weight of the assemblies and the rolls 548 provide a lighter pressure but help to maintain belts 536 in engagement with the upper run of belt 512 along its entire length. As was the case of previously described pressure device assemblies it provides for variations in thickness of the insert material.

Located forward of rollers 526 and outside of belts 536 are additional pressure rolls 568. Each roll 568 is rotatably mounted on one end of a lever 570 which is pivoted at 572 to a fixed bracket 574. A spring 576 engages an upper portion 575 of each lever 570 so that rolls 568 are urged downwardly against belt 512. Rolls 568 are located abreast of the entering nips between belts 536 and belt 512 to maintain bottom flap 30 in overlying relationship with the insert material as the charged envelope passes from rolls 526 to the nip between belts 536 and belt 512. Pulleys 540 are adjustably mounted as shown in FIG. 17. The forward end of each side plate 546 includes an adjustable roller supporting portion 578 which includes a slot 580 by which it is slidably mounted on a pin 582. A screw 584 extends freely through a downwardly projecting arm 58 of portion 578 and is threaded into a block 586 fixed to the main portion of the side plate 546.

As the charged envelope blank is advanced between belts 536 and belt 512 along the second path *b* the end flaps 37 pass through gluing stations, generally indicated at 590, located on opposite sides of the belts 536 and 512.

Referring particularly to FIGS. 1B, 16, 18 and 19, each gluing station 590 comprises a storage tank 592 which receives its supply of glue from an inverted bottle 594. A horizontal shaft 596 extends through and is supported by the side wall of the tank 592. A wheel 598 is fixed to one end of shaft 596 and extends vertically inside the tank 592 so that its lower end is immersed in the glue. A bevel gear 600 is fixed to the opposite end of shaft 596 and meshes with a bevel gear 602 fixed to a shaft 604 which is journaled in a lower support 606. Bevel gear 602 meshes with a third bevel gear 608 fixed to one end of a horizontal shaft 610 which is supported by a bracket 612. The opposite end of shaft 610 is fixed to a segmented gluing wheel 614. A glue transfer wheel 616 is fixed to shaft 604. A pulley 618 is fixed to shaft 596 and is driven from a pulley 620 by a belt 622 for rotating shaft 596. Wheels 598, 614 and 616 are all rotated by the rotation of shaft 596 through their interconnected bevel gear drive. Pulley 620 is driven from a pulley 623 through a one rotation clutch 624. Pulley 623 is driven from motor 434 by a belt 626. When clutch 624 is energized, wheels 598 and 614 make one revolution by means of their interconnected drive elements. Wheel 598 picks up glue from the bottom of the tank 592 and transfers it to transfer wheel 616 which then transfers the glue to segmented gluing wheel 614. However, wheel 616 contacts only a segmented outer peripheral portion 628. Clutch 624 is energized through electrical circuitry to be described which is initiated from the actuation of a switch arm 630 by the charged envelope as it moves from the inserting and first transfer station 228 to belt 512. The timing of the circuitry and glue station drive is such that the segment 628 engages the end flap 39 just as it passes through the gluing station. The positioning of gluing wheel 614 and the timing is such that glue is applied to only that portion of the end flap 39 which will overlie the bottom flap 30 upon folding of the end flap as shown in FIG. 3.

Pulley 620 is fixed to a horizontal shaft 625 which extends across the width of the machine to an identical pulley 620 for driving the glue station 590 on the other side of the machine. After the end flaps 39 have been glued, they are folded into sealing relationship with bottom flap 30 as the charged envelope blank advances past secondary plow stations, generally indicated by the reference numeral 632 located on opposite sides of belt 512 just ahead of the gluing stations 590.

Figure 1B:
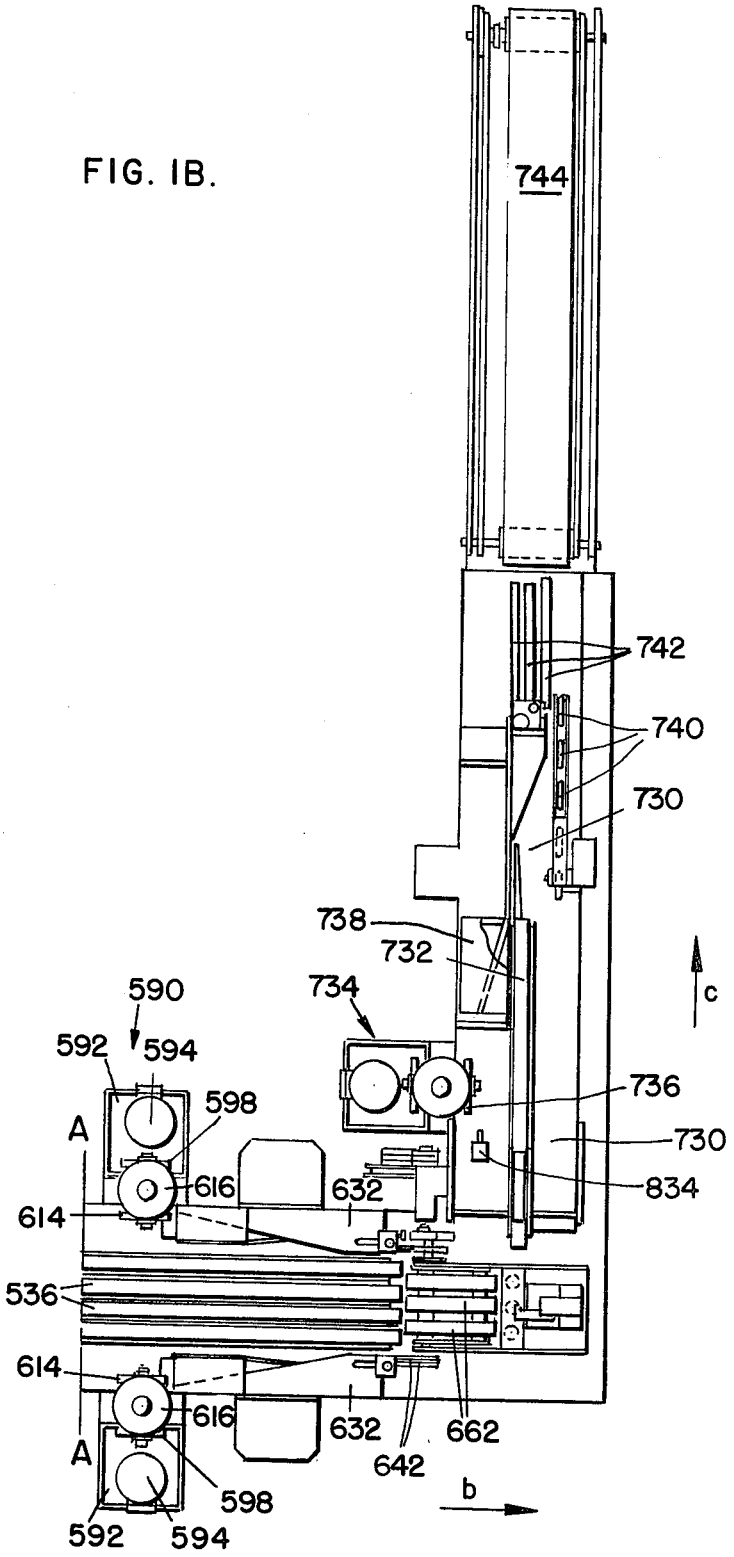
Figure 20:
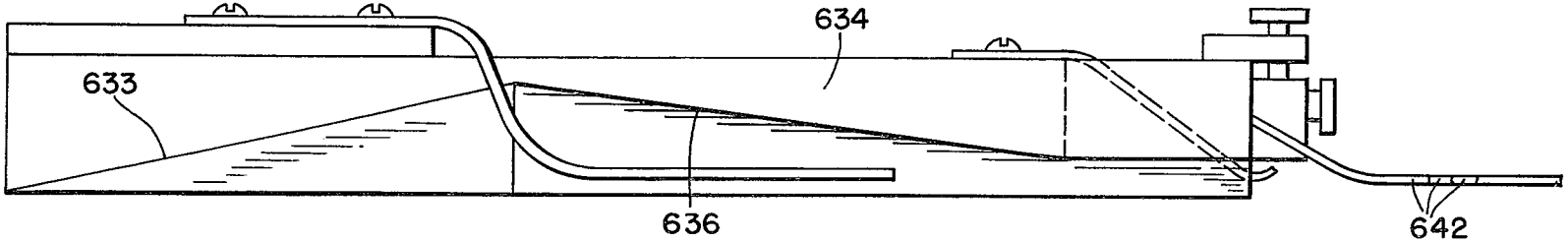
FIG. 20 is a side elevation of one of the plow stations for folding the end flaps of the envelope.
Figure 22:
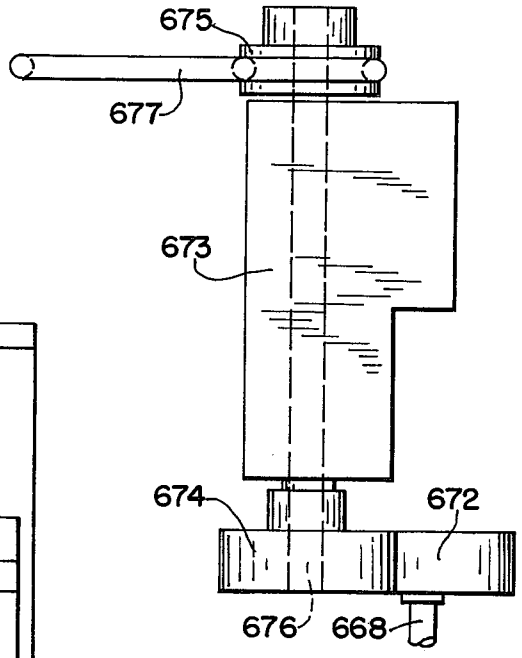
FIG. 22 is a fragmentary plan view of a portion of the drive for the second transfer station.
Figure 21:
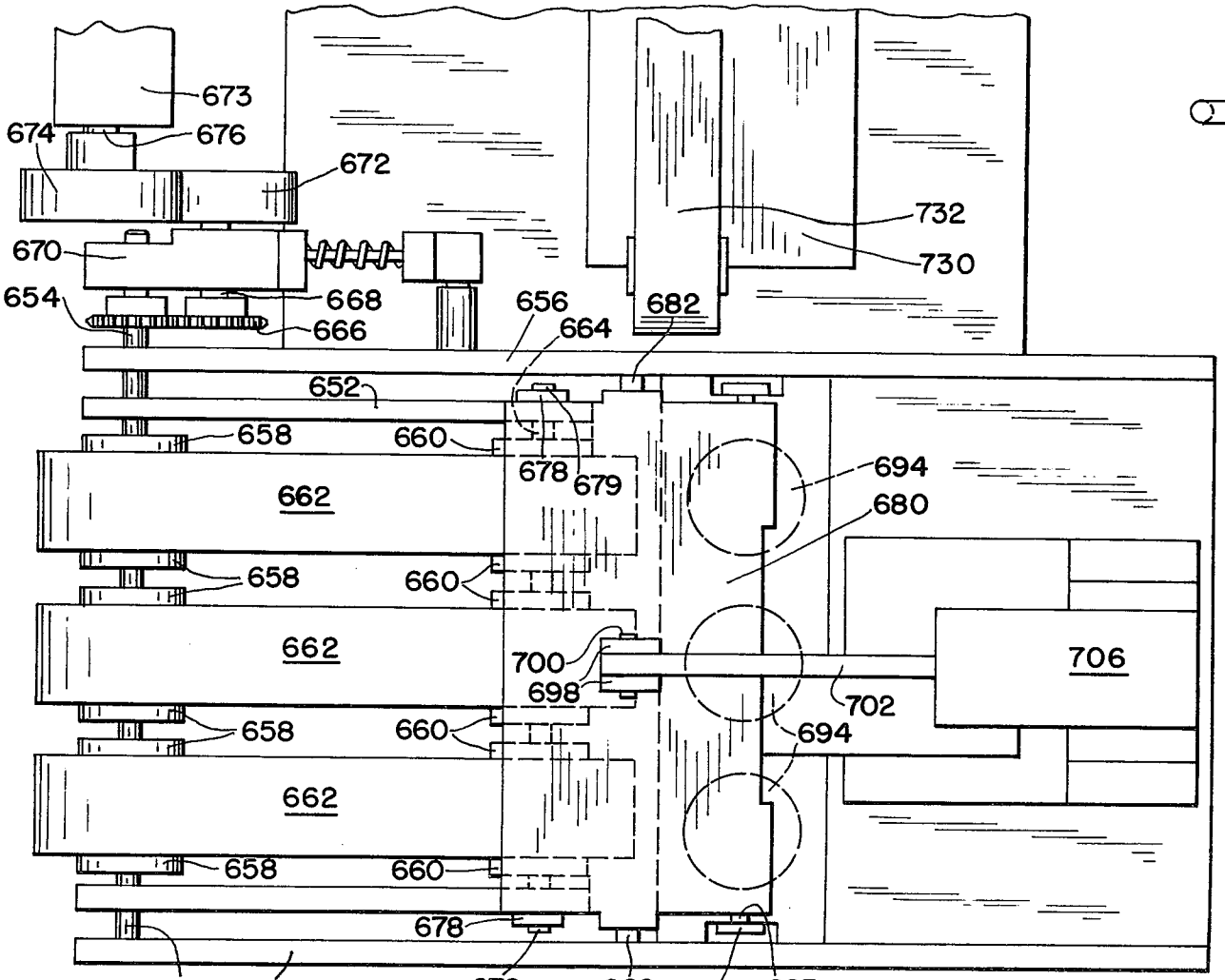
FIG. 21 is a fragmentary plan view of the second transfer station.
Figure 23:
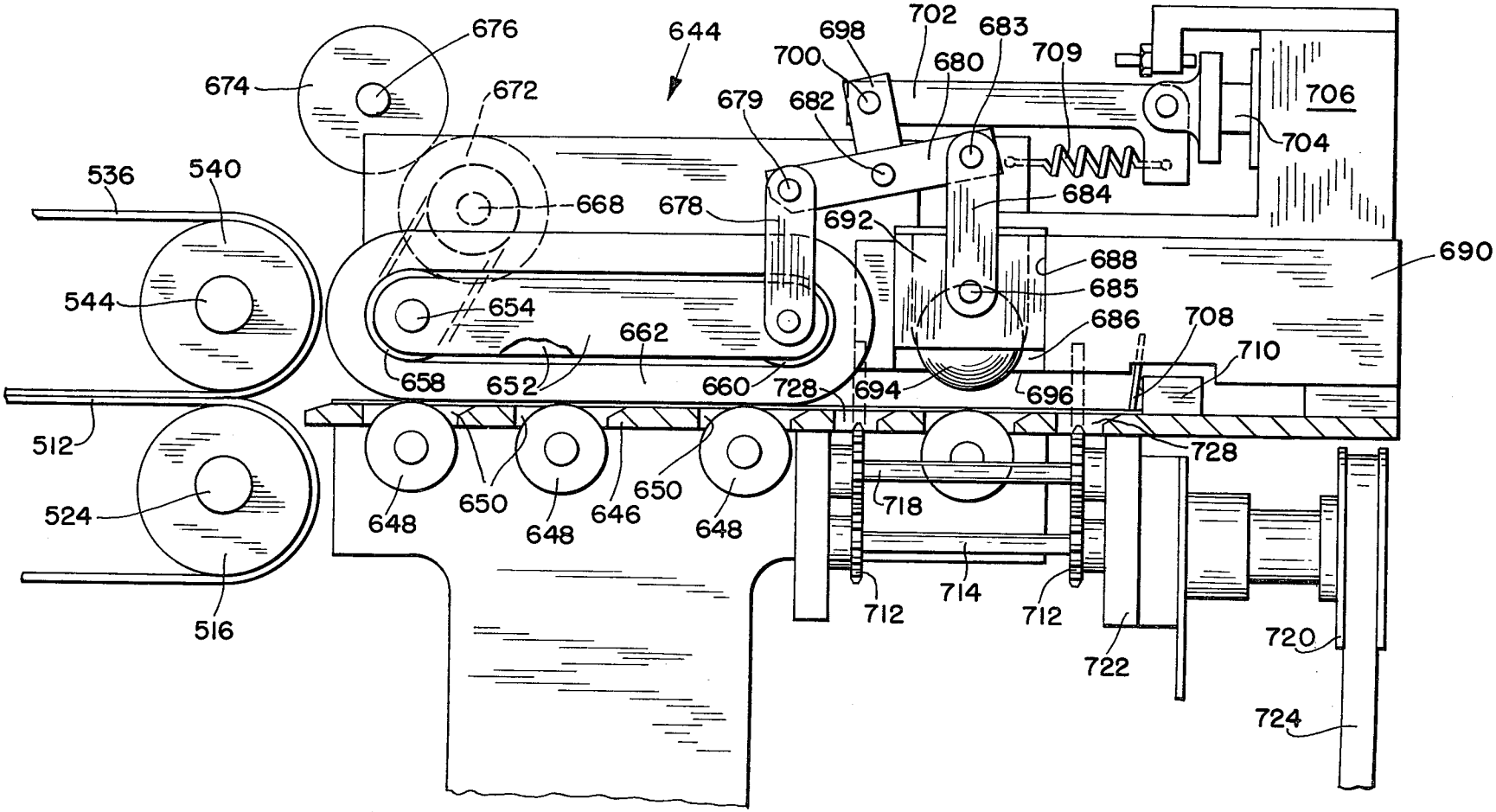
FIG. 23 is a side elevation of the second transfer station with portions in section.

As viewed in FIGS. 1B, 16 and 20, each secondary plow station 632 comprises an inclining ramp 633 and an overhanging portion 634 which has a declining undersurface 336. As the charged envelope blank is advanced between plow stations 332, each envelope is folded by its respective plow station. The flap 39 first rides up inclining ramp 633 and is folded to a vertical position. The flap 39 is then folded over the bottom flap 30 by engagement with declining undersurface 636. A resilient paper holder 643 retains the charged envelope while the end flaps are being folded. After the end flaps 39 have been folded, they are pressed into sealing relationship with bottom flaps 30 by elongated spring members 642 which extend forwardly from the forward end of each plow station and downwardly in contact with belt 512.

SECOND TRANSFER STATION

The charged envelope blank with the end flaps folded into sealing relationship with bottom flap 30 is advanced by belts 536 and 512 into the second transfer station generally indicated by the reference numeral 644, see FIGS. 1B and 21 through 25.

Second transfer station 644 comprises a table 646 and a plurality of rollers 648 which are rotatably mounted below table 646 so that their upper portions extend above the upper surface of the table 646 through openings 650. A pair of levers 652 are pivotably mounted at their rearward ends on a shaft 654 which is journaled in fixed supporting brackets 656. A plurality of pulleys 658 are keyed to shaft 654 between levers 652. Pulleys 658 are drivingly connected to pulleys 660 by belts 662. Pulleys 660 are mounted for rotation on a shaft 664 which is supported by the forward ends of levers 652.

Shaft 654 is driven by means of a chain and sprocket drive 666 from a shaft 668 journaled in a supporting block 670. Shaft 668 is fixed to a friction drive wheel 672 which is driven by a friction drive wheel 674 which is keyed to a shaft 676. Shaft 676 is rotatably mounted in a support block 673 and is keyed to a pulley 675 which is driven by conventional drive means, not shown, from motor 434 by a belt 677. Rollers 648 are also driven by conventional drive means, not shown, from motor 434. Rollers 648 are driven clockwise as viewed in FIG. 23 and belts 662 are driven so that their lower runs travel in the direction in which the charged envelope blanks are advanced along second path *b*.

Shaft 664 is rotatably supported by the lower ends of a pair of rearward vertical links 678. The upper ends of links 678 are pivotably connected at 679 to the rearward end of a flat generally horizontal plate 680 which is pivotably supported at 682 to supporting brackets 656. The upper ends of a pair of forward vertical links 684 are pivotably connected at 683 to the forward end of plate 680. The lower ends of links 684 are pivotably connected at 685 to a block 686 slidably disposed within a slot 688 in a supporting block 690. Block 686 has a plurality of cavities 692 within which are loosely contained balls 694. Openings 696 at the bottom of cavities 692 allow the balls to protrude below the lower surface of the block 686 but have diameters which are less than the diameters of the balls 694 to maintain the balls within cavities 692.

Plate 680 has a pair of central upwardly extending brackets 698 which are pivotably connected at 700 to a horizontal arm 702 connected to a solenoid plunger 704 of a solenoid 706. Energization of solenoid 706 causes plunger 704 and arm 702 to be pulled to the right as viewed in FIG. 23 which rocks plate 680 clockwise around pivot 682. The rocking action of plate 680 causes shaft 644 to be lowered by links 684 into engagement with the last roller 648 toward the end of the second transfer station 644. A spring 709 urges arm 702 to the left as viewed in FIG. 23 when solenoid 706 is de-energized.

As the charged envelope blank enters the second transfer station 644 it is advanced to the end of the station by belts 662 and rollers 648. When the envelope blank reaches the end of the station 644 it strikes a switch arm 708 and swings the switch arm against a stop 710 which arrests the progress of the envelope blank along the second path *b*. The movement of switch arm 708 causes solenoid 706 to become energized through electrical circuitry to be described, whereupon belts 662 are lifted away from the charged envelope blank and balls 694 are lowered on top of the envelope blank in pressing cooperation with the last roller 648 to maintain the envelope blank against switch arm 708.

The means for initiating the advance of the charged envelope blank along the third path *c* from second transfer station 644 comprises a pair of sprockets 712 keyed to a shaft 714 located below table 646. A second pair of sprockets 716 also located below table 646 are mounted on a shaft 718 and are drivenly connected to sprocket 712 by chains 719. Shaft 712 is rotated by a pulley 720 through a one rotation clutch 722. Pulley 720 is driven by a belt 724 which is driven from motor 434 by conventional driving means, not shown. A plurality of sets of pusher fingers 726 are mounted on chains 719 and extend outwardly therefrom. Shaft 714 is located below shaft 718 and is driven in a clockwise direction as viewed in FIG. 25. Shafts 712 and 718 are positioned so that as the upper runs of chains 719 advance from sprocket 716 to sprocket 712, pusher fingers 726 move from a position below table 646 through openings 728 in the table to a position above the table as shown in FIG. 25. Clutch 722 is energized after belts 662 are raised and block 686 is lowered so that a set of pusher fingers 726 moves from a position above table 646 and engage the charged envelope blank to push it out of the second transfer station 644 along the third path *c*. Balls 694 will allow the charged envelope blank to be pushed along path *c* which is perpendicular to path *b* and maintain pressure against the envelope blank.

ADVANCE OF CHARGED ENVELOPE BLANK ALONG THE THIRD PATH

Referring to FIG. 1B, the charged envelope blank is continued to be advanced along the third path *c* after transfer from the second transfer station 644 by the upper run an endless conveyor belt 730 which is driven from motor 434 by conventional drive means, not shown. An endless pressure belt 732 similar to belt 536 located above belt 730 has a lower run which engages the upper run of belt 730 and is driven thereby to maintain the charged envelope blank in advancing engagement with conveyor belt 730. Belts 730 and 732 form an entering nip for receiving the charged envelope from the third transfer station 644. As the charged envelope blank is advanced by conveyor belt 730, it first passes by a glue station 734 which is similar to previously described glue station 590 except that the glue applying wheel indicated at 736 is not segmented and has a continuous outer glue applying periphery and is driven continuously. As the charged envelope blank passes by the glue station 734, wheel 736 applies glue to the closure flap 31 after which the flap is folded into sealing relationship with the end flaps and bottom flap as it passes a third plow station 738 which is similar to one of the plow stations 632. All of the plow stations disclosed are conventional and any of the well-know designs of the prior art may be employed for folding the envelope flaps. The charged envelope blank is maintained in advancing relationship with conveyor belt 730 by pressure rolls 740. After the closure flap 31 has been folded by the plow station 738, it is pressed into sealing relationship with end flaps 39 and bottom flap 30 by pressure members 742. The charged and completed envelope is transferred from conveyor 730 to a discharge conveyor 744.

Figure 29:
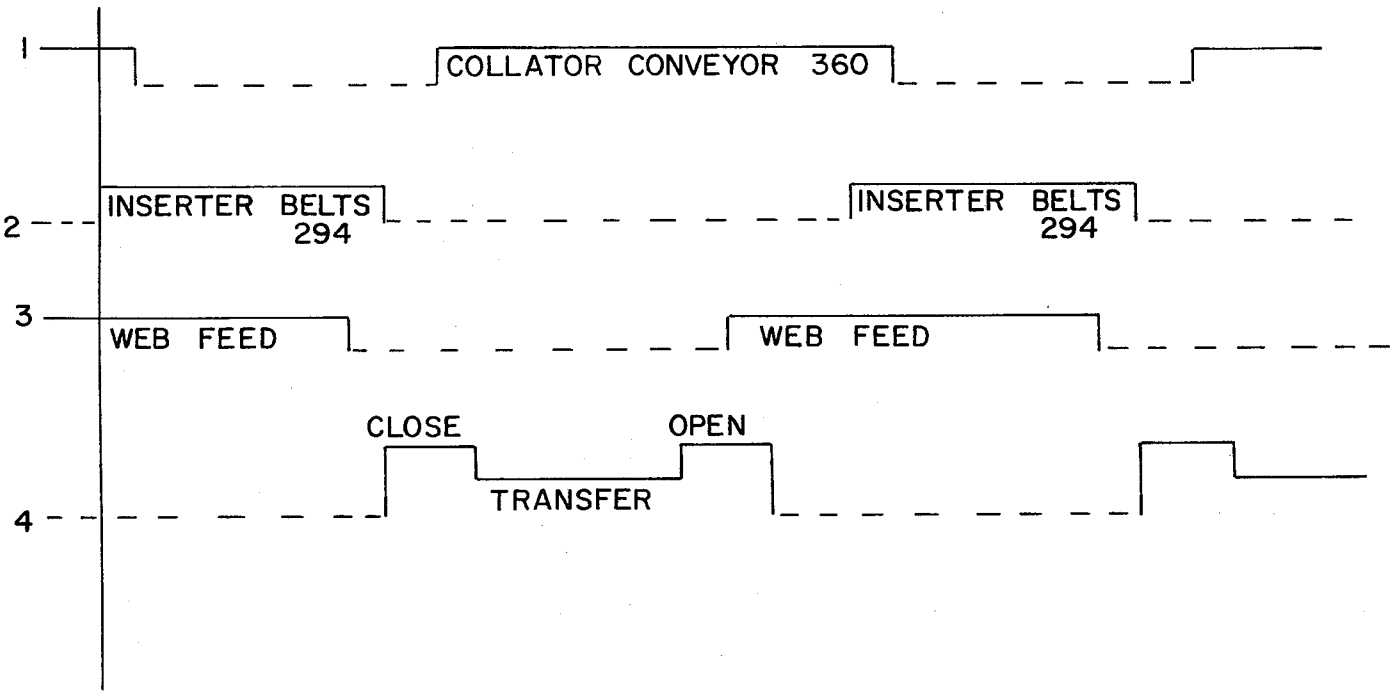
FIG. 29 is a timing diagram of the various machine components.

Referring to FIG. 29, there is shown a timing diagram for some of the machine components. The solid lines indicate the period of time when a function takes place and the dotted lines when there is no activity.

Line 1 represents the movement of the collator conveyor 360 and the functioning of cam 352 as controlled by clutch 366. Line 2 represents the movement of insert belts 294 as controlled by clutch 316. Line 3 represents the intermittent web feed by rolls 92 and 94. Line 4 represents the functioning of the mechanism for transferring the charged envelope from the first transfer station as governed by the operation of clutch 460. The active solid line portion of line 4 is divided into three parts. The close and open parts representing the motion of the upper and lower assemblies 400 and 402 respectively to and from their transfer positions and the transfer portion representing the period of time in which the assemblies are in their transfer positions.

ELECTRICAL CONTROL CIRCUITRY

Figure 26:
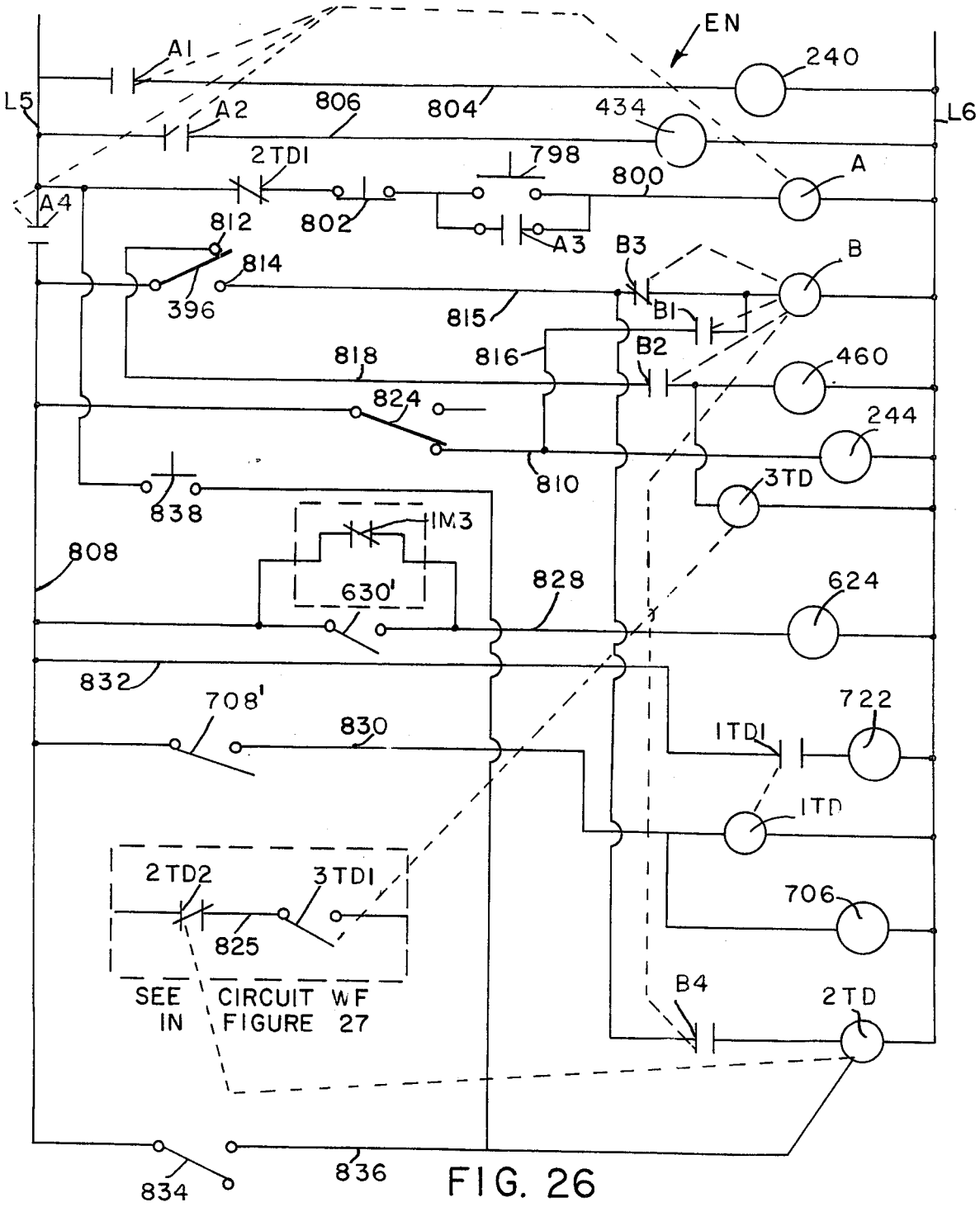
FIG. 26 is an electrical diagram for controlling the mechanism for advancing the charged envelope blank along the second path.
Figure 27:
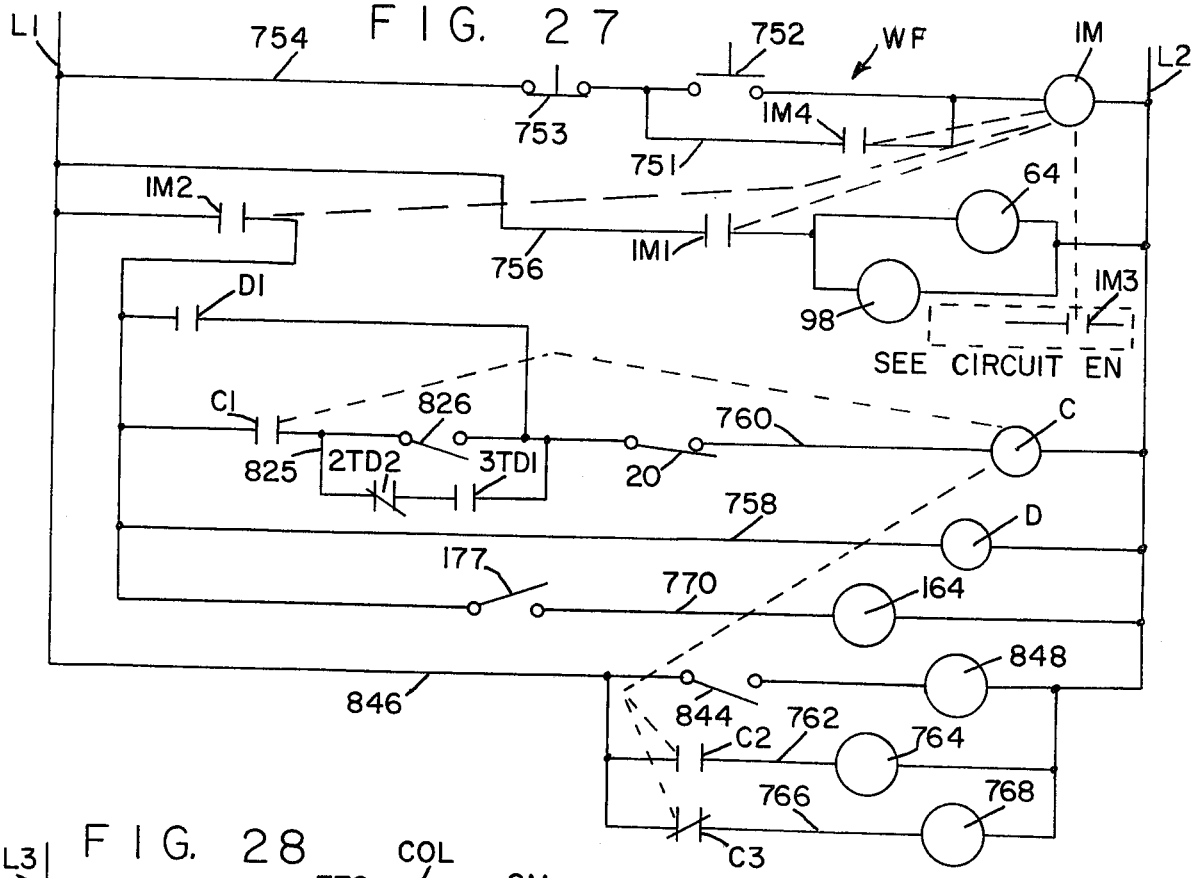
FIG. 27 is an electrical diagram for controlling the web advancing apparatus along the first path.
Figure 28:
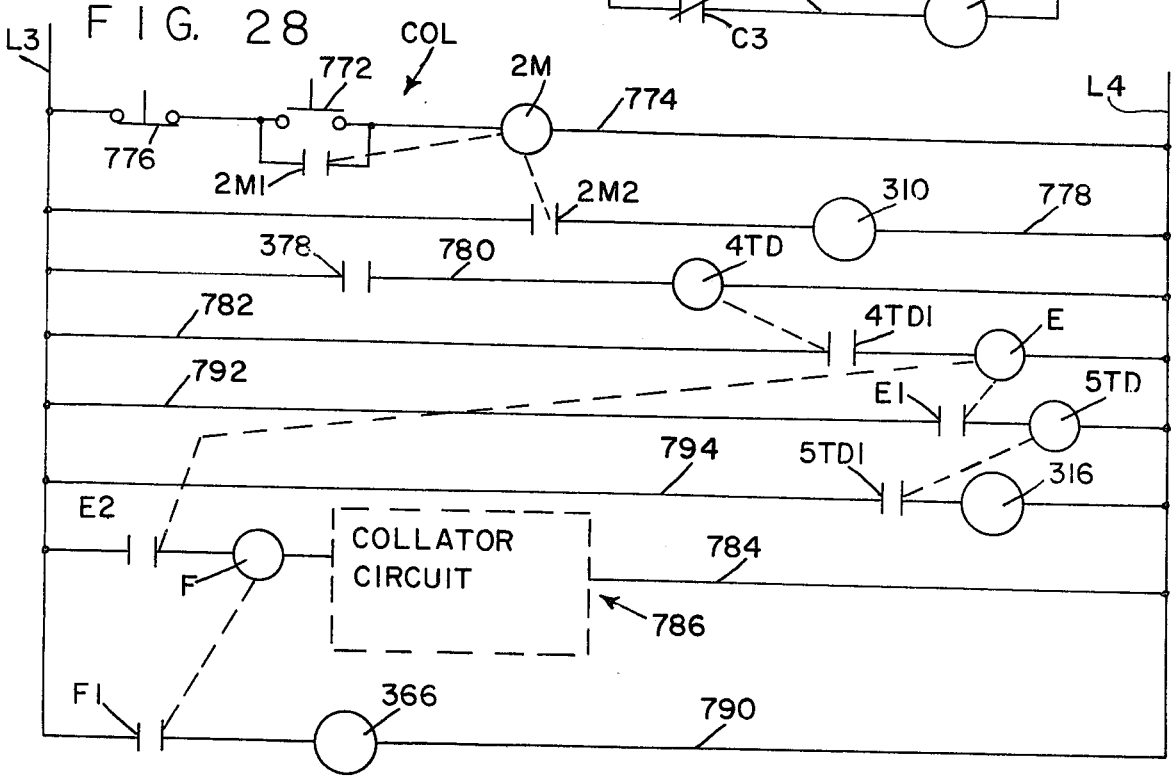
FIG. 28 is an electrical diagram for controlling the collator and mechanism for charging insert material into an envelope blank.

The circuitry for controlling the machine is divided into three separate circuits illustrated in FIGS. 26, 27 and 28, respectively. The circuitry shown in FIG. 26 controls the mechanism generally associated with the second and third paths *b* and *c*. The circuitry shown in FIG. 27 controls the mechanism generally associated with the first path *a*. The circuitry in FIG. 28 is associated with the collator motor 310 although other machine functions are also involved. All three circuits are tied together in certain areas since the many machine functions are correlated so that the three circuits represent a single control means for the entire machine.

Referring first to FIG. 27, the circuit shown therein is generally referred to as the web feed circuit generally indicated by the reference WF. The circuit in FIG. 26 generally controls the envelope after it has been severed from the web circuit is referred to as the envelope circuit and is generally indicated by the reference EN. The circuit represented by FIG. 28 is referred to as the collator circuit and is generally indicated by the reference COL.

Web feed circuit WF comprises a pair of power lines L1 and L2. Closure of a start button 752 completes a circuit across line 754 and energizes a relay IM which closes normally open contacts 1M1, 1M2, and 1M4 and opens a normally closed contact 1M3 in the circuit EN shown in FIG. 26 to be described. Closure of contact 1M4 completes a bridging circuit 751 across start switch 752 to keep line 754 energized after the button is released. A stop switch 753 is also located in line 754.

Closure of contact 1M1 completes a circuit across line 756 and energizes motors 64 and 98. Closure of contact 1M2 completes a circuit across line 758 and energizes a relay D which closes a normally open contact D1. Closure of contact D1 completes a circuit across line 760 and energizes a relay C which closes normally open contacts C1 and C2 and opens a normally closed contact C3.

Closure of contact C2 completes a circuit across line 762 to energize clutch coil 764 and opening of contact C3 breaks the circuit across line 766 to de-energize brake coil 768. Coils 764 and 768 form part of the brake and clutch gear reducer assembly 102 shown in FIG. 2 which is driven from motor 98.

Upon energization of motors 64 and 98, and clutch 764 and de-energization of brake 768, the paper web is advanced along first path *a* by rollers 92 and 94. At the proper time, cam 178 closes switch 177 to complete a circuit across line 770 and energize single revolution clutch brake unit 164 to drive scoring roll 86.

Referring to FIG. 28, circuit COL comprises a pair of power lines L3 and L4. A start switch 772 is closed to complete a circuit through line 774 which energizes a relay 2M which closes normally open contacts 2M1 and 2M2. Contact 2M1 completes a circuit across start switch 772 to keep 2M energized when switch 772 is released. A stop switch 776 is also located in line 774 for de-energizing relay 2M. Closing of relay 2M2 completes a circuit across line 778 and energize collator motor 310.

When the leading envelope blank reaches the inserting and first transfer station 228 it interrupts the light beam from light source 376 and closes photo-electric sensor 378. Closing of sensor 378 completes a circuit across line 780 and energizes time delay relay 4TD. After a short period of time, allowing the envelope blank to advance an additional amount, timer delay relay closes normally open contact 4TD1. Closing of contact 4TD1 completes a circuit across line 782 which energizes a relay E whereupon its normally open contacts E1 and E2 will close. Closing of contact E2 will complete a circuit across line 784 and energize a relay F and supply power to collator circuit generally indicated at 786. The type of collator which is used or the manner in which it is controlled is not critical to the present invention. Many of the well known collators of insert material may be utilized. All that is required is that operation of the collater be initiated and that it is effective to deliver a charge of insert material to the inserting apparatus 280 upon a signal which in the present case is initially from the photo-electric sensor 378. Only those electrical components which relate to the present envelope machine are shown in FIG. 28.

Energization of relay F closes normally open contact F1 which completes a circuit across line 790 and energizes one rotation clutch 366. Closing of contact E1 completes a circuit across line 792 and energizes time delay relay 5TD. After a predetermined time interval, normally open contact 5TD1 of relay 5TD closes and completes a circuit across line 794 and energizes clutch 316 which runs for a predetermined period of time at which time, contact 5TD1 will open and clutch 316 will be de-energized. Once that the light beam is re-established from light 376 to sensor 378, all of the relays 4TD, E and 5TD will become de-energized. This occurs when the leading envelope is transferred from the first transfer station 228.

When clutch 316 is energized, belts 294 will be driven to insert the charge of insert material into the pocket of the leading envelope blank defined by bottom flap 30. When this occurs, switch arms 394 are depressed and switch 396 is actuated to initiate a transfer operation as will be seen from the following description of the envelope circuit EN in FIG. 26.

Referring to FIG. 26, envelope circuit EN comprises a pair of power lines L5 and L6. A start switch 798 is closed completing a circuit across line 800 and energizes a relay A which closes normally open contacts A1, A2, A3 and A4. Closing of contact A3 completes a circuit across start switch 798 to maintain relay A energized when start switch 798 is released. A stop switch 802 is also located in line 800 for de-energizing relay A. Closing of contacts A1 and A2 completes circuits across lines 804 and 806 respectively and energizes vacuum pump 240 and motor 434 respectively.

Closing of contact A4 connects power line L5 to line 808 and completes a circuit across line 810 thereby energizing valve 244 to connect pump 240 to outlet port 239 of the vacumn table housing 230.

When arms 394 are depressed, switch 396 breaks contact with a pole 812 and makes contact with a pole 814 which completes a circuit through line 815 and energizes a relay B. Normally open contacts B1 and B2 are closed and normally closed contact B3 and B4 are opened upon energization of relay B. Opening of contact B3 breaks the circuit through line 815. However closing of contact B1 maintains relay B energized by connecting relay B to line 810 through a line 816. Closing of contact B2 completes a circuit across line 818 upon return of switch 396 to pole 812 after the insert material has been discharged from belts 294. Once a circuit is completed across line 818, one rotation clutch 460 is energized to initiate a transfer operation, see FIG. 10. A shaft 820 which rotates with cam 450 has mounted thereon a cam 822 which causes a switch 824 to open and de-energize valve 244 to shut off the vacuum to port 239. This releases the charged envelope blank from the housing and allows it to be transferred from station 228 by the first transfer means 400, 402. Opening of switch 824 also de-energizes relay B which returns contacts B1, B2 and B3 to their normal state. After the first transfer means returns to its non-transferring condition, switch 824 is closed to energize valve 244.

When clutch 460 is energized a timer relay 3TD is also energized to close a normally open contact 3TD1 in contact WF after a predetermined time interval. Closing of contact 3TD1 completes a bridging circuit 825 across a switch 826 which is opened by lever 214 when it lowers cutoff blade 202 to the lower position. Contact 3TD1 is closed when switch 826 opens. This maintains power through line 760 and keeps relay C energized to keep clutch 764 energized and brake 768 de-energized so that web 10 will continue to be advanced. If for any reason no insert material is discharged into the envelope pocket so that switch 396 is not actuated, timer relay 3TD will not be energized and contact 3TD1 will not be closed. When the cutoff blade 202 reaches its lower position, switch 826 will be opened and relay C will be de-energized. This will open contact C3 and close contact C2 to energize brake coil 768 and de-energize clutch coil 764 to stop the advance of web 10 until such time as the insert material is delivered to the leading envelope blank.

As the charged envelope blank leaves the inserting and first transfer station 228, it actuates switch arm 630, see FIG. 17, and closes switch 630'. Upon closing of switch 630', a circuit is completed across line 828 energizing one revolution clutch 624 for activating glue stations 590, see FIG. 19. Switch arm 630 is so positioned that the end flaps 39 pass beneath wheels 614 of the glue station just as segments 628 pass through the lower portion of their rotation, thereby applying glue to end flap 39 as shown in FIG. 3. If, for any reason, the circuit WF is deactivated so that relay IM drops out, one of its contacts 1M3 closes. Closing of contact 1M3 completes a bridging circuit across switch 630' and keep clutch 624 energized. The gluing stations 590 will continue to operate until relay 1M is again energized. This will keep the glue circulating and prevent any of it from setting on any of the wheels 598, 616 and 614.

When the charged envelope blank reaches the end of second transfer station 644, switch arm 708 is activated to close switch 708', whereupon a circuit is completed across line 830 to energize solenoid 706 and a timer relay 1TD. After a predetermined time period allowing the charged envelope blank to settle down, relay 1TD closes its normally open contact 1TD1 whereupon a circuit is completed across line 832 to energize one rotation clutch 722. Solenoid 706 raises belts 662 from engagement with the envelope blank and lowers balls 694 into engagement with the envelope blank. Thereafter, clutch 722 is energized enabling pusher fingers 726 to transfer the charged envelope blank out of the second transfer station 644, see FIGS. 23 through 25.

After the charged envelope blank leaves the second transfer station 644 and is advanced along the third path C it closes a normally open safety switch 834, see FIG. 1B. A safety time delay relay 2TD is energized when contact B4 of relay B is closed. Relay 2TD is a permanent magnet latch relay with a pneumatic timing head attachment and has two coils. When it is first energized one of the coils is latched in to keep itself energized and after a period of time the other coil is energized to open its normally closed contacts 2TD1 and 2TD2. This time is sufficient to allow an envelope blank to be transferred from the inserting and first transfer station 228, through second transfer station 644 and along third path c until it closes switch 834. If switch 834 is closed by the leading charged envelope blank at the proper time, a circuit will be completed across line 836 so that time delay relay 2TD will be reset and contacts 2TD1 and 2TD2 will not be opened. If the charged envelope blank does not reach switch 834, relay 2TD will open contacts 2TD1 and 2TD2. Opening of contact 2TD2 will break the circuit across bridging line 825 in circuit WF of FIG. 27. After cutoff blade 202 reaches its lower position, switch 826 will be opened to break te circuit across line 760 and de-energize relay C thereby closing contact C2 and opening contacts C1 and C3. This energizes brake coil 768 and de-energizes clutch coil 764 to discontinue the intermittent advance of the paper web. Opening of relay 2TD1 breaks the circuit across line 800 of circuit EN and deenergizes relay A which in turn opens contacts A1, A2 and A3. This de-energizes pump 240 and motor 434. If a jam of envelopes occurs between the first and second transfer stations, no additional envelope blanks will advance until the jam is cleared up. Once the machine is clear of envelopes, a timer reset switch 838 is closed to reset relay 2TD to its original state before energization by closing of contact B4.

If the paper web 10 runs out or a break in the web occurs, switch 20 opens to break the circuit across line 760 in FIG. 27 and de-energize relay C, thereby closing contact C2 and opening contacts C1 and C3. This energizes brake coil 768 and de-energizes clutch coil 764.

Referring again to circuit WF in FIGS. 27 and 2, shaft 100 has affixed thereto a wheel 840 which has a projecting pin 842. For each rotation of shaft 100, pin 842 closes a switch 844 located below shaft 100. Closing of switch 844 completes a circuit across line 846 in circuit 27 and energizes a brake 848 mounted on shaft 110 but not shown in FIG. 2. Energization of brake 848 prevents overtravel of crank arm 112 and insures that all of the elements which are driven from shaft 110 will stop at a predetermined desired position after each web advancing cycle and particularly upon stopping of the machine.

I claim:

1. A method of forming envelopes from a continuous paper web and for incorporation of insert material into the envelopes during their formation comprising the following steps:

(a) intermittently advancing along a first path a paper web comprising defined envelope blanks having a bottom flap on one side of said web, a closure flap on the opposite side of said web, at each end thereof;

(b) folding each of said bottom flaps to form a pocket during advance of said web;

(c) stopping the advance of said web at a predetermined position;
(d) severing the leading envelope blank from said web;
(e) charging insert material into the pocket defined by the bottom flap of said severed envelope blank while restraining said severed envelope blank;
(f) urging the bottom flap of said charged envelope blank into overlying relationship with the inserted material;
(g) advancing said charged envelope blank from said predetermined position along a second path which is perpendicular to said first path in a direction which is opposite to the opening of said pocket; and
(h) applying adhesive material to the end flaps and closure flap of said charged envelope and folding said end and closure flaps into sealing relationship to form a completed charged envelope.

2. A method of forming envelopes from a continuous paper web and for incorporation of insert material into the envelope during their formation comprising the following steps:
(a) intermittently advancing a paper web along a first path;
(b) scoring said web along longitudinal and transverse lines and notching said web at spaced intervals for defining an envelope blank having a bottom flap on one side of said web, a closure flap on the opposite side of said web, and an end flap at each end thereof;
(c) folding each of said bottom flaps during passage of said web along said first path so that it forms an acute angle with the upper surface of its respective blank to form a pocket;
(d) stopping the advance of said web with the leading end thereof located at a predetermined position;
(e) creating subatmospheric pressure beneath said leading envelope blank when it is in said predetermined position for holding said envelope blank in said position;
(f) severing the leading envelope blank from said web;
(g) charging insert material into the pocket defined by the bottom flap of said severed envelope blank;
(h) advancing said charged envelope blank from said predetermined position along a second path in a direction which is opposite to the opening of said pocket and urging the bottom flap thereof into overlying relationship with said insert material;
(i) applying adhesive to each of the end flaps into sealing relationship with the bottom flap of said charged envelope blank;
(j) folding said glued end flaps into sealing relationship with the bottom flap of said charged envelope blank;
(k) applying adhesive to the closure flap of said charged envelope blank; and
(l) folding the glued closure flap of said charged envelope blank into sealing relationship with the bottom and end flaps.

3. In a method of forming and stuffing an insert into and sealing an envelope blanked from a paper web, the steps of: Intermittently advancing the web in a first advancing mode along a first linear path,
scoring the web along preselected longitudinal and transverse lines and notching the web at preselected spaced intervals for defining the bottom and closure and end flaps of eventually-in seriatim-severed blanks during advance along the first linear path,
forming a pocket in the leading web end by folding the bottom flap,
bringing the web to a non-advancing mode and registering and holding the leading web end in a preselected seized position,
severing the leading web end in a blank forming manner,
charging the insert into the pocket,
pressing the bottom flap into overlying relationship with the insert,
advancing the stuffed blank in a second advancing mode away from the pressing and seizing position along a second linear path perpendicular to the first linear path,
gluing each of the blank end flaps and folding the blank end flaps into sealing relationship with the bottom flap during advance along the second linear path,
terminating the advance of the blank along the second linear path,
advancing the blank in a third advancing mode along a third linear path perpendicular to the second linear path,
gluing the blank closure flap during advance along the third linear path,
folding the blank closure flap into sealed relationship with the bottom and end flaps during advance along the third linear path, and
discharging the fully loaded and sealed blank at the terminus of the third linear path.

4. A machine for forming envelopes from a continuous paper web and for incorporation of insert material into the envelopes during their formation comprising:
(a) means for intermittently advancing along a first path a paper web comprising defined envelope blanks having a bottom flap on one side of said web, a closure flap on the opposite side of said web and an end flap at each end thereof;
(b) primary flap folding means for partially folding each of said bottom flaps to form a pocket having an acute angle during advance of said web;
(c) means for stopping the advance of said web with the leading end thereof at a predetermined position;
(d) means for severing the leading envelope blank from the web while said closure and end flaps remain in the same plane as said web;
(e) means for charging insert material into the pocket defined by the bottom flap of said severed envelope blank;
(f) means for restraining a leading envelope blank during charging of insert material into the pocket defined by the bottom flap of said envelope blank;
(g) a backup plate which abuts the pocket defined by the bottom flap of said leading envelope blank during charging of insert material into said pocket;
(h) means for urging the bottom flap of said charged envelope blank into overlying relationship with the inserted material;
(i) means for advancing said charged envelope blank from said predetermined position along a second path which is perpendicular to said first path in a direction which is opposite to the opening of said pocket; and means for applying adhesive material to the end flaps and closure flap of said charged envelope and folding said end and closure flaps into sealing relationship to form a completed charged envelope.

5. A machine as set forth in claim 4 wherein said backup plate is pivoted at its lower end and said machine comprises means for swinging said backup plate into a substantially parallel position with respect to said charged envelope blank for urging said bottom flap into overlying relationship with the inserted material.

6. A machine as set forth in claim 4 comprising a primary transfer means for transferring said charged envelope blank from said first path to said second path.

7. A machine as set forth in claim 6 wherein said primary transfer means comprises:

(a) an upper set of rolls located above said charged envelope blank normally out of contact with said charged envelope blank;

(b) a lower set of rolls located below said charged envelope blank normally out of contact with said charged envelope blank;

(c) means for driving at least one set of said upper and lower rolls; and (d) means for bringing said upper and lower sets of rolls into contact with said upper charged envelope blank so that they cooperate to transfer said charged envelope blank from said first path to said second path.

8. A machine as set forth in claim 7 wherein one of said sets of rolls are non-driven idler rolls which are resiliently mounted to accomodate variations in thickness of insert material.

9. A machine as set forth in claim 4 wherein the means for advancing said charged envelope blanks along said second path comprises:

(a) upper and lower sets of endless belts having confronting runs and forming an entering nip at one end thereof;

(b) means for driving one set of said belts so that said confronting runs travel in said second direction;

(c) resilient means for urging the confronting runs of the non-driven set of belts against the confronting runs of said driven set of belts to urge said confronting runs into driving relationship and to accomodate variations in thickness of insert material; and (d) primary transfer means for transferring said charged envelope from said predetermined position into the nip of said upper and lower sets of endless belts.

10. A machine as set forth in claim 4 wherein the means for advancing said charged envelope blanks along said second path comprises:

(a) upper and lower endless belts having confronting runs which extend along said second path and which form an entering nip at one end thereof;

(b) means for driving said confronting runs in said second direction; and (c) primary transfer means for transferring said charged envelope from said preselected position into the nip of said upper and lower endless belts.

11. A machine as set forth in claim 4 wherein the means for advancing said web along said first path comprises:

(a) a pair of rollers, at least one of which is intermittently driven; and (b) suction means for engaging the leading end of said web and advancing it to said preselected position.

12. A machine as set forth in claim 11 wherein said suction means comprises:

(a) a housing located beneath said preselected position and having a chamber and a plurality of spaced openings extending from the upper surface of said housing into said chamber, said aperture extending along a line which is parallel to said first path;

(b) at least one endless belt having an upper run which extends over the upper surface of said housing, the longitudinal axis of which is parallel to said first path, said endless belt having apertures which extend along the same line as the openings in said housing;

(c) means for creating subatmospheric pressure within said chamber to create suction at said openings; and (d) means for intermittently driving the upper run of said endless belt along said first path in timed relation with said rollers to assist said rollers in advancing the leading end of said web to said preselected position.

13. A machine as set forth in claim 4 wherein the means for applying adhesive to each end flap of said charged envelope blank comprises a segmented glue carrying wheel for gumming only that portion of the end flap which will overlie the bottom flap of the envelope blank when folded thereon.

14. A machine for forming envelopes from a continuous paper web and for incorporation of insert material into the envelopes during their formation comprising:

(a) means for intermittently advancing a paper web along a first path;

(b) means for scoring said web along longitudinal and transverse lines and notching said web at spaced intervals for defining an envelope blank having a bottom flap on one side of said web, a closure flap on the opposite side of said web, and an end flap at each end thereof;

(c) primary flap folding means for partially folding each of said bottom flaps during passage of said web along said first path so that it forms an acute angle with the upper surface of its respective blank to form a pocket;

(d) means for stopping the advance of said web with the leading end thereof located at a predetermined position;

(e) means for creating subatmospheric pressure beneath said leading envelope blank when it is in said predetermined position for holding said envelope blank in said position;

(f) means for severing the leading envelope blank from said web;

(g) means for charging insert material into the pocket defined by the bottom flap of said severed envelope blank;

(h) means for advancing said charged envelope blank from said predetermined position along a second path which is perpendicular to said first path in a direction which is opposite to the opening of said pocket and urging the bottom flap thereof into overlying relationship with said insert material;

(i) means for applying adhesive to each of the end flaps of said charged envelope blank;

(j) means for folding said glued end flaps into sealing relationship with the bottom flap of said charged envelope blank;

(k) means for applying adhesive to the closure flap of said charged envelope blank; and (l) means for folding the glued closure flap of said charged envelope blank into sealing relationship with the bottom and end flaps.

15. A machine as set forth in claim 14 wherein said insert charging means comprises:

(a) normally inactive conveyor means for storing insert material adjacent said predetermined position;

(b) means for sensing the leading end of said web as it enters said predetermined position and for generating a signal; and (c) electromechanical means operatively connected to said sensing means for activating said conveyor means for transferring said stored insert material into the pocket defined by the bottom flap of said leading envelope blank.

16. A machine for forming envelopes from a continuous paper web and for incorporation of insert material into the envelopes during their formation comprising:

(a) means for intermittently advancing a paper web along a first path;

(b) means for scoring said web along longitudinal and transverse lines and notching said web at spaced intervals for defining an envelope blank having a bottom flap on one side of said web, a closure flap on the opposite side of said web, and an end flap at each end thereof;

(c) primary flap folding means for partially folding each of said bottom flaps to form a pocket during passage of said web along said first path;

(d) means for stopping the advance of said web with the leading envelope blank thereof located at a predetermined position;

(e) means for severing the leading envelope blank from said web;

(f) means for charging insert material into the pocket defined by the bottom flap of said severed envelope blank;

(g) means for urging the bottom flap of said charged envelope blank into overlying relationship with the inserted material;

means for advancing said charged envelope blank along a second path which is perpendicular to said first path in a direction which is opposite to the opening of said pocket;

(i) means for applying adhesive to each of the end flaps of said charged envelope blank during passage of said charged envelope along said second path;

(j) means for folding said glued end flaps into sealing relationship with the bottom flap of said charged envelope blank during passage thereof along said second path;

(k) means for advancing said charged envelope along a third path which is perpendicular to said second path;

(l) means for applying adhesive to the closure flap of said charged envelope; and (m) means for folding the closure flap of said charged envelope into sealing relationship with the bottom and end flaps during passage along said third linear path.

17. A machine as set forth in claim 16 wherein the means for advancing said charged envelope along said third path comprises:

(a) a pair of endless belts having opposing runs which form an entering nip at one end thereof;

(b) means for driving said runs along said third path;

(c) means for stopping the advance of said charged envelope along said second path at a predetermined second position; and (d) secondary transfer means for advancing said charged envelope from said second predetermined position along said third path into the nip of said endless belts.

18. A machine as set forth in claim 17 wherein said secondary transfer means comprises:

(a) pusher fingers;

(b) a switch including a switch arm positioned adjacent the end of said second path to be struck and moved by the leading end of said charged envelope blank so as to close said switch;

(c) electromechanical means responsive to the closing of said switch for moving said pusher fingers along said third path through said second predetermined position for pushing said charged envelope into the nip of said endless belts.

19. A machine as set forth in claim 16 comprising:

(a) a stop at the end of said second path for stopping the advance of said charged envelope along said path at a predetermined second location;

(b) a plurality of drive rollers located beneath said second path at said second predetermined location for urging said charged envelope against said stop;

(c) secondary transfer means for advancing said charged envelope from said second predetermined position along said third path;

(d) an upper pressure assembly having a ball bearing surface which is movably mounted between an inactive position and an active position for engaging the top of a charged envelope and cooperating with at least one of said rollers for urging said envelope toward said stop and also allowing said envelope to be advanced from said second predetermined position along said third path; and (e) actuating means for maintaining said ball bearing surface in inactive position in the absence of an envelope blank at said second predetermined position and for maintaining said ball bearing surface in active position when an envelope blank is in said second predetermined position.

20. A machine as set forth in claim 19 wherein said actuating means comprises:

(a) a switch which is activated by the leading end of an envelope blank reaching said stop; and (b) a solenoid actuated mechanism for normally maintaining said ball bearing surface in inactive position and for urging said ball bearing surface into active position upon activation of said switch.

* * * * *